US008602803B2

(12) United States Patent
Fukano et al.

(10) Patent No.: US 8,602,803 B2
(45) Date of Patent: Dec. 10, 2013

(54) WATERPROOF SOCKET AND ILLUMINATION APPARATUS

(75) Inventors: Satoshi Fukano, Nara (JP); Masashi Takeda, Osaka (JP); Tetsuya Matsumoto, Gunma, PA (US); Hirokazu Saegusa, Hyogo (JP)

(73) Assignee: Panasonic Corporation, Osaka (JP)

( * ) Notice: Subject to any disclaimer, the term of this patent is extended or adjusted under 35 U.S.C. 154(b) by 21 days.

(21) Appl. No.: 13/528,296

(22) Filed: Jun. 20, 2012

(65) Prior Publication Data

US 2012/0329303 A1 Dec. 27, 2012

(30) Foreign Application Priority Data

Jun. 23, 2011 (JP) ..... 2011-139772
Aug. 3, 2011 (JP) ..... 2011-170179

(51) Int. Cl.
*H01R 13/52* (2006.01)

(52) U.S. Cl.
USPC ..... 439/271

(58) Field of Classification Search
USPC ..... 439/271, 274, 275, 279, 226, 239, 417, 439/833
See application file for complete search history.

(56) References Cited

U.S. PATENT DOCUMENTS

| | | | | |
|---|---|---|---|---|
| 1,878,229 | A * | 9/1932 | Beck | 439/230 |
| 1,977,106 | A * | 10/1934 | Wylie | 439/274 |
| 2,048,891 | A * | 7/1936 | Rabezzana | 313/134 |
| 2,698,926 | A * | 1/1955 | Young | 439/372 |
| 2,774,947 | A * | 12/1956 | Frensch | 439/230 |
| 3,005,971 | A * | 10/1961 | Lennox | 439/230 |
| 3,040,287 | A * | 6/1962 | Agron et al. | 439/275 |
| 6,641,418 | B2 * | 11/2003 | Takahashi et al. | 439/226 |
| 7,568,930 | B2 * | 8/2009 | Brand et al. | 439/234 |
| 7,736,163 | B2 * | 6/2010 | Vogt et al. | 439/239 |
| 7,862,357 | B2 * | 1/2011 | Tufano et al. | 439/239 |
| 8,007,302 | B2 * | 8/2011 | Kleinke | 439/275 |
| 8,038,458 | B2 * | 10/2011 | Tufano et al. | 439/239 |
| 2009/0297256 | A1 | 12/2009 | Gross, III | |
| 2011/0136363 | A1 * | 6/2011 | Yaali | 439/232 |
| 2012/0302079 | A1 * | 11/2012 | Sun | 439/226 |

FOREIGN PATENT DOCUMENTS

| | | |
|---|---|---|
| DE | 9405817 | 6/1994 |
| DE | 102004033180 | 2/2006 |
| EP | 2128934 | 12/2009 |

(Continued)

OTHER PUBLICATIONS

Search report from E.P.O., mail date is Jan. 31, 2013.

*Primary Examiner* — Neil Abrams
*Assistant Examiner* — Phuongchi T Nguyen
(74) *Attorney, Agent, or Firm* — Greenblum & Bernstein, P.L.C.

(57) ABSTRACT

A waterproof socket includes a socket body having an insertion hole to which a lamp pin protruding from an end cap of a straight tube lamp is inserted, a first internal sleeve making contact with the socket body, and a second internal sleeve. The socket body includes a body-side rotation restraint portion engaging with a sleeve-side rotation restraint portion formed in the first internal sleeve to restrain the first internal sleeve from rotating about a center axis of the straight tube lamp. The first internal sleeve includes a first position restraint portion and the second internal sleeve includes a second position restraint portion engaging with the first position restraint portion to restrain the second internal sleeve from rotating about the center axis while allowing the second internal sleeve to move in an axial direction of the straight tube lamp.

16 Claims, 17 Drawing Sheets

(56) References Cited

FOREIGN PATENT DOCUMENTS

| | | |
|---|---|---|
| JP | 11-345665 | 12/1999 |
| JP | 11-354235 | 12/1999 |
| JP | 2001-052830 | 2/2001 |
| JP | 2005-108594 | 4/2005 |
| JP | 2009-129836 | 6/2009 |
| JP | 2010-056096 | 3/2010 |

* cited by examiner

WATERPROOF SOCKET AND ILLUMINATION APPARATUS

FIELD OF THE INVENTION

The present invention relates to a waterproof socket for holding a straight tube lamp and an illumination apparatus provided with the waterproof socket.

BACKGROUND OF THE INVENTION

In the past, an illumination apparatus provided with a lamp socket for holding a fluorescent lamp has been extensively used as an illumination apparatus for home or various kinds of facilities. As one example of the lamp socket, there is available a waterproof socket endowed with a waterproof property or a dustproof property in consideration of its use in an outdoor area or around water.

As one example of this kind of waterproof socket, there is known a waterproof socket capable of holding a straight tube fluorescent lamp (not shown) as shown in FIG. 12 (see, e.g., Japanese Patent Application Publication No. 2001-52830 (JP2001-52830A)). The waterproof socket includes a socket body 711 having an insertion hole for receiving a pair of lamp pins protruding from an end cap of a straight tube fluorescent lamp, a second waterproof packing 715 and a tightening sleeve assembly 714 detachably attached to the socket body 711 to cover and conceal the outer circumferential surface of the end portion of the straight tube fluorescent lamp. The tightening sleeve assembly 714 includes a tightening sleeve 717, a slip ring 718, a first waterproof packing 713 and a packing presser 719.

In this regard, the socket body 711 includes a base portion 721, a thread coupling portion 722 having a male thread 725 formed on the outer circumferential surface of a portion connected to the base portion 721, a packing rest 723 and a front wall 724 configured to close the front surface of the thread coupling portion 722. On the outer circumferential surface of the thread coupling portion 722, there is provided a proximal portion 722*a* serving as a packing fitting portion. The second waterproof packing 715 is fitted to the proximal portion 722*a*. In the thread coupling portion 722, there is provided a lamp pin insertion groove 726 lying at the tip end of the socket body 711 and extending across the male thread 725. In the front wall 724, there is formed a lamp pin rotating groove 727 having a bifurcated shape.

An inwardly-tapered edge portion 731 is formed in the opening of the tightening sleeve 717. A female thread threadedly coupled to the male thread 725 is formed on the rear inner circumferential surface of the tightening sleeve 717. The slip ring 718 is accommodated within the tightening sleeve 717 to make contact with the inner surface of the inwardly-tapered edge portion 731. The first waterproof packing 713 and the packing presser 719 are accommodated within the tightening sleeve 717. The first waterproof packing 713 is interposed between the packing presser 719 and the slip ring 718. The slip ring 718 is used to enable the tightening sleeve 717 to easily rotate with respect to the first waterproof packing 713 when rotationally operating the tightening sleeve 717 in a tightening direction. The packing presser 719 is fitted to the inner circumferential surface of the first waterproof packing 713. An outwardly-facing flange 741 making contact with the first waterproof packing 713 is formed in the packing presser 719. A plurality of engaging lugs 742 protrudes backward from the flange 741. As the engaging lugs 742 come into engagement with engaging recesses 728, the packing presser 719 is restrained from circumferentially rotating with respect to the socket body 711.

As another example of this kind of waterproof socket, there is known a waterproof socket 75 capable of holding a straight tube fluorescent lamp 77 as shown in FIGS. 13 and 14 (see, e.g., JP2001-52830A).

The waterproof socket 75 includes a socket body 711 for receiving lamp pins 77*b* protruding from an end cap 77*a* of a straight tube fluorescent lamp 77. The waterproof socket 75 further includes a second waterproof packing 715 and a tightening sleeve assembly 714 detachably attached to the socket body 711 to cover the end portion of the straight tube fluorescent lamp 77.

In this regard, the tightening sleeve assembly 714 includes a tightening sleeve 717, a first waterproof packing 713 and a packing presser 719. The socket body 711 includes a base portion 721, a thread coupling portion 722 having a male thread 725 formed on the outer circumferential surface of a portion connected to the base portion 721, a packing rest 723 and a front wall 724 configured to close the front surface of the thread coupling portion 722. On the outer circumferential surface of the thread coupling portion 722, there is provided a proximal portion 722*a* serving as a packing fitting portion. The second waterproof packing 715 is fitted to the proximal portion 722*a*. In the thread coupling portion 722, there is provided a lamp pin insertion groove 726 lying at the tip end of the socket body 711 and extending across the male thread 725. In the front wall 724, there are provided an entrance 727*a* formed continuously with the lamp pin insertion groove 726 and a lamp pin rotating groove 727 having a bifurcated shape. Attachment grooves 721*a* for engaging with a socket mount not shown in the drawings are formed on the opposite side surfaces of the base portion 721.

An inwardly-tapered edge portion 731 is formed in the opening of the tightening sleeve 717. A female thread 732 threadedly coupled to the male thread 725 is formed on the rear inner circumferential surface of the tightening sleeve 717. The first waterproof packing 713 and the packing presser 719 are accommodated within the tightening sleeve 717. The first waterproof packing 713 is interposed between the packing presser 719 and the tightening sleeve 717. A plurality of engaging lugs 742 protrudes backward from the packing presser 719. The engaging lugs 742 engage with engaging recesses 728 of the socket body 711. The packing presser 719 includes an inwardly-tapered packing pressing flange 719*a* formed at the front end thereof. Drive-in lugs 719*b* protrude from the front surface of the packing pressing flange 719*a*. In addition to the engaging lugs 742, a plurality of hooking lugs 719*c* is formed in the rear end portion of the packing pressing flange 719*a* to protrude outward. The hooking lugs 719*c* are elastically deformed to climb over a portion of the female thread 732 and to come into a thread groove.

As the waterproof socket 75 is assembled together, the first waterproof packing 713 is deformed to make close contact with the outer circumferential surface of the straight tube fluorescent lamp 77. This makes it possible to assure waterproof.

In recent years, an LED lamp using light emitting diodes becomes widespread. The LED lamp is longer in lifespan than a fluorescent lamp and is capable of reducing power consumption. There are also developed a straight tube LED lamp as an alternative light source of the straight tube fluorescent lamp and an illumination apparatus for a straight tube LED lamp. The straight tube LED lamp includes two lamp pins protruding from one end cap of a tube body and one lamp pin protruding from the other end cap of the tube body. Japanese Lamp Industries Association enacts a standard (JEL801:2010) entitled "Straight Tube LED Lamp System (for General Light Purpose) Provided with L-Type-Pin End Cap GX16t-5".

Just like the conventional straight tube fluorescent lamp, the straight tube LED lamp requires a waterproof socket endowed with a waterproof property or a dustproof property in consideration of its use in an outdoor area or around water.

The straight tube LED lamp includes an earth end cap provided with one earth lamp pin and a power-feeding end cap provided with two power-feeding lamp pins. The earth end cap needs to be electrically connected to the earth prior to connecting the power-feeding end cap to a power source. This necessitates a waterproof socket of rotary structure to which a straight tube LED lamp can be mounted by rotating the LED lamp about the center axis thereof. In case of the waterproof socket for a straight tube fluorescent lamp, it is sometimes required to use a waterproof socket of rotary structure in order to prevent a human from touching the other lamp pin while one lamp pin is electrically connected to the waterproof socket and supplied with electric power.

The waterproof socket disclosed in JP2001-52830A is a socket of plug-in structure to which a straight tube fluorescent lamp is mounted by inserting the lamp pins of the lamp into insertion holes. If no change is made, the waterproof socket cannot be used in mounting a straight tube LED lamp. It is thinkable that the waterproof socket disclosed in JP2001-52830A is applied to the rotary socket. However, if the waterproof socket disclosed in JP2001-52830A is merely applied to the rotary socket, there may be sometimes generated co-rotation by which the straight tube LED lamp is unintentionally rotated together with the tightening sleeve 717 when tightening the tightening sleeve 717 to the socket body 711. In particular, the straight tube lamp is easy to rotate about the center axis thereof in the rotary waterproof socket to which the straight tube lamp such as a straight tube LED lamp or a straight tube fluorescent lamp is mounted by rotating the lamp about the center axis thereof.

In the waterproof socket applied to the rotary socket, it is therefore likely that the electric connection between the straight tube lamp and the waterproof socket becomes poor.

In case of the straight tube LED lamp, the light irradiated by the LED lamp has directivity. If the LED lamp is not mounted to the socket in a specified position due to the co-rotation of the LED lamp, there is posed a problem in that the inaccurate mounting of the LED lamp tends to affect the distribution of the light irradiated from the LED lamp.

In the straight tube LED lamp provided with an L-type end cap complying with the standard stated above, it is sometimes the case that, unlike the straight tube fluorescent lamp, the outer diameter of the end cap is larger than the outer diameter of the light emitting tube.

In the event that the waterproof socket 75 disclosed in JP2001-52830A is applied to a waterproof socket for holding a straight tube LED lamp, the light emitting tube needs to be brought into close contact with the first waterproof packing 713 after the end cap is inserted into the tightening sleeve assembly 714. This is because the outer diameter of the end cap is larger than the diameter of the light emitting tube. In the waterproof socket 75 for the straight tube LED lamp, the first waterproof packing 713 needs to be deformed more largely than in the waterproof socket 75 for the straight tube fluorescent lamp 77 so that the first waterproof packing 713 can be brought into close contact with the light emitting tube smaller in outer diameter than the end cap. If the deformation amount of the first waterproof packing 713 is too large, unintentional buckling is generated before the first waterproof packing 713 makes contact with the light emitting tube of the straight tube LED lamp. Therefore, there is a possibility that the first waterproof packing 713 gets away from the opening of the tightening sleeve 717 to the outside of the waterproof socket 75. In this case, a problem is posed in that the adhesion between the waterproof socket 75 and the straight tube LED lamp becomes insufficient and the moisture is easily infiltrated into the waterproof socket 75.

SUMMARY OF THE INVENTION

In view of the above, the present invention provides a waterproof socket capable of restraining unintentional rotation of a straight tube lamp and an illumination apparatus provided with the waterproof socket.

In addition, the present invention provides a waterproof socket packing capable of enjoying an enhanced waterproof property, a waterproof socket provided with the waterproof socket packing and an illumination apparatus provided with the waterproof socket.

In accordance with first aspect of the present invention, there is provided waterproof socket, including: a socket body having an insertion hole to which a lamp pin protruding from an end cap of a straight tube lamp is inserted, the straight tube lamp being mounted to the waterproof socket by rotating the straight tube lamp about a center axis thereof; a tightening cover for covering the end cap of the straight tube lamp mounted to the socket body, the tightening cover being tightened to the socket body by thread coupling about the center axis; a first internal sleeve making contact with the socket body; a tubular seal for restraining moisture from infiltrating through between the straight tube lamp and the tubular seal; and a second internal sleeve for accommodating the seal and pressing the seal against the first internal sleeve upon tightening the tightening cover, wherein the first internal sleeve, the seal and the second internal sleeve being arranged between the socket body and the tightening cover in the named order from the socket body toward the tightening cover and the straight tube lamp is inserted through the second internal sleeve, the seal, and the first internal sleeve, wherein the socket body includes a body-side rotation restraint portion engaging with a sleeve-side rotation restraint portion formed in the first internal sleeve to restrain the first internal sleeve from rotating about the center axis, and wherein the first internal sleeve includes a first position restraint portion and the second internal sleeve includes a second position restraint portion engaging with the first position restraint portion of the first internal sleeve to restrain the second internal sleeve from rotating about the center axis while allowing the second internal sleeve to move in an axial direction of the straight tube lamp.

Preferably, one of the first position restraint portion and the second position restraint portion may be a raised portion and the other is a cutout portion or a groove portion engaging with the raised portion.

Preferably, one of the sleeve-side rotation restraint portion and the body-side rotation restraint portion may be a protruding portion and the other is a recessed portion engaging with the protruding portion.

Preferably, the sleeve-side rotation restraint portion may have a serrated shape, and the body-side rotation restraint portion may have a serrated shape so that the body-side rotation restraint portion engages with the sleeve-side rotation restraint portion to allow the first internal sleeve to rotate about the center axis in one direction while restraining the first internal sleeve from rotating in the other direction opposite to said one direction.

Preferably, the tightening cover may include a female thread formed on an inner circumferential surface thereof and threadedly coupled to the socket body, the female thread having insertion passage portions extending in the axial direction; the first internal sleeve has lug portions formed on an outer circumferential surface thereof, the lug portions being inserted through the insertion passage portions; and the lug portions lock to the female thread in a position where the lug portions get out of alignment with the insertion passage portions in a circumferential direction about the center axis of the straight tube lamp.

Preferably, the insertion passage portions may have a width growing smaller away from the socket body.

Preferably, the circumferential interval between the insertion passage portions may differ from the circumferential interval between the lug portions about the center axis.

In accordance with second aspect of the present invention, there is provided an illumination apparatus including the waterproof socket of the above described first aspect of the present invention.

In accordance with third aspect of the present invention, there is provided a packing for use in a waterproof socket having a socket body having an insertion hole to which a lamp pin protruding from an end cap of a straight tube lamp is inserted, and a tightening cover for covering the end cap of the straight tube lamp mounted to the socket body, the tightening cover being tightened to the socket body by thread coupling about the center axis, the packing being arranged between the socket body and the tightening cover to prevent moisture from infiltrating through between the packing and the straight tube lamp, the straight tube lamp being inserted through the packing, the packing including: a first contact portion making contact with the socket body; a second contact portion making contact with the tightening cover; and a close-contact portion arranged between the first contact portion and the second contact portion, the close-contact portion being one-piece formed with the first contact portion and the second contact portion, the close-contact portion being configured to make close contact with a light emitting tube of the straight tube lamp, wherein outer circumferential surfaces of the packing extending from the close-contact portion to the first contact portion and extending from the close-contact portion to the second contact portion along an axial direction of the straight tube lamp are formed into an outwardly-bulging curved surface shape, and wherein an inner diameter of the first contact portion and an inner diameter of the second contact portion are larger than an inner diameter of the close-contact portion in a packing opening through which the straight tube lamp is inserted.

Preferably, an outer diameter and a radial thickness of the packing may be increased from the close-contact portion toward the first contact portion and from the close-contact portion toward the second contact portion along the axial direction of the straight tube lamp.

Preferably, an inner diameter and a radial thickness of the packing may be increased from the close-contact portion toward the first contact portion and from the close-contact portion toward the second contact portion along the axial direction of the straight tube lamp.

Preferably, the packing may further include a thin portion with a smallest radial thickness arranged at least between the close-contact portion and the first contact portion or between the close-contact portion and the second contact portion.

Preferably, the first contact portion and the second contact portion may be symmetrical with respect to the close-contact portion.

Preferably, the packing may further include a jutting portion formed in the close-contact portion to protrude inwardly, the jutting portion being brought into contact with the straight tube lamp and deformed in an insertion direction of the straight tube lamp when the straight tube lamp is inserted through the packing.

In accordance with fourth aspect of the present invention, there is provided an waterproof socket including the packing of the above described third aspect of the present invention.

In accordance with fifth aspect of the present invention, there is provided an illumination apparatus including the packing of the above described fourth aspect of the present invention.

The present invention has a remarkable effect in that it can provide a waterproof socket capable of restraining unintentional rotation of a straight tube lamp.

The present invention has a remarkable effect in that it can provide an illumination apparatus provided with a waterproof socket capable of restraining unintentional rotation of a straight tube lamp.

The present invention has a remarkable effect in that it can provide a waterproof socket packing capable of enjoying an enhanced waterproof property.

The present invention has a remarkable effect in that it can provide a waterproof socket capable of enjoying an enhanced waterproof property.

The present invention has a remarkable effect in that it can provide an illumination apparatus provided with a waterproof socket capable of enjoying an enhanced waterproof property.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS (First Embodiment)

Figure 1A:
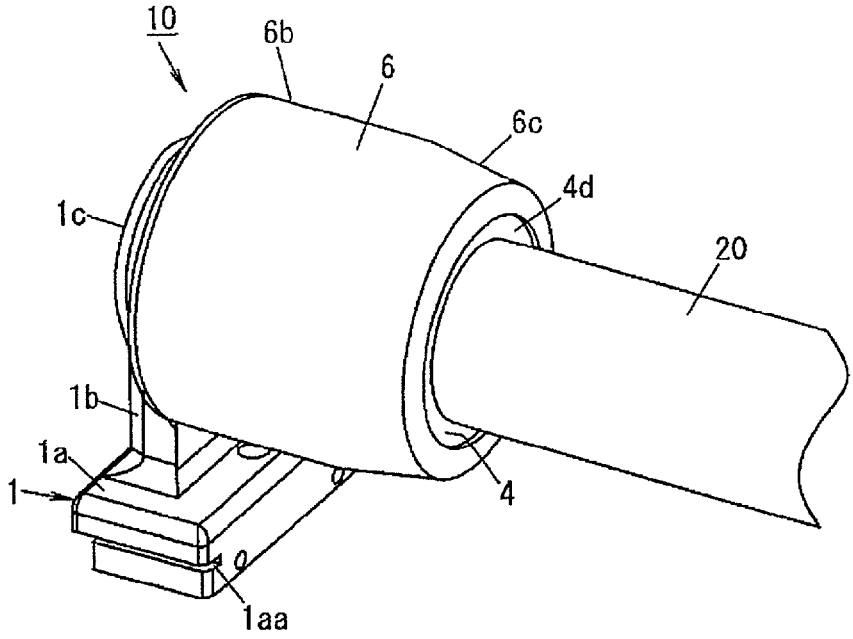
FIG. 1A is a schematic perspective view of a waterproof socket according to a first embodiment of the present invention, showing a use state in which a straight tube lamp is mounted to the waterproof socket.

A waterproof socket 10 according to a first embodiment of the present invention will be described with reference to FIGS. 1A and 2. A straight tube lamp 20 will be described with reference to FIGS. 3A and 3B. Throughout the respective figures, identical components will be designated by like reference symbols with no repeated description made thereon.

First, description will be made on the straight tube lamp 20 to be mounted to the waterproof socket 10 of the present embodiment. The straight tube lamp 20 is formed of a straight tube LED lamp provided with an L-type end cap. The straight tube lamp 20 shown in FIG. 3A includes a light emitting tube 21 as a tube body formed into a cylindrical straight tube shape by a light-transmitting material (e.g., glass or synthetic resin). End caps are provided at the axial opposite end portions of the light emitting tube 21. The straight tube lamp 20 to be mounted to the waterproof socket 10 of the present embodiment includes a first power-feeding end cap 22 of cylindrical closed-bottom shape arranged at one end portion of the lamp 20 so as to cover one end portion of the light emitting tube 21 and a second grounding end cap 23 of cylindrical closed-bottom shape arranged at the other end portion of the lamp 20 so as to cover the other end portion of the light emitting tube 21.

While not shown in the drawings, a mounting substrate (e.g., a ceramic substrate) of rectangular plate shape having a length slightly smaller than that of the light emitting tube 21 is arranged within the light emitting tube 21. On one surface of the mounting substrate, there is formed a circuit pattern for electrically interconnecting a plurality of light emitting diodes (not shown) mounted on the mounting substrate at a specified interval. The light emitting diodes are capable of emitting white light. On the other surface of the mounting substrate, there is provided a reflecting plate (not shown) having a C-like cross section. The reflecting plate includes a bottom portion making contact with the other surface of the mounting substrate and a pair of side wall portions protruding from the bottom portion. The side wall portions are arranged to reflect the light emitted from the light emitting diodes in a specified direction. The reflecting plate is made of aluminum. The reflecting plate serves as a heat sink for dissipating the heat of the light emitting diode from the other surface of the mounting substrate to the outside through the bottom surface.

Figure 3A:
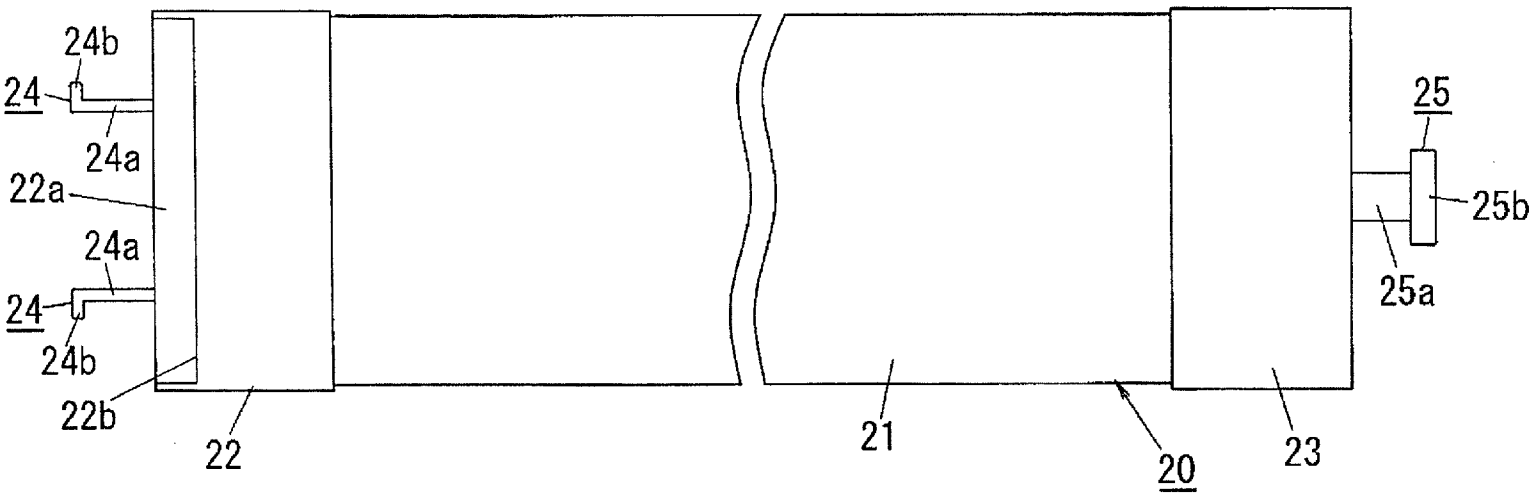
FIG. 3A is a front view showing a straight tube lamp mounted to the waterproof socket of the first embodiment.
Figure 3B:
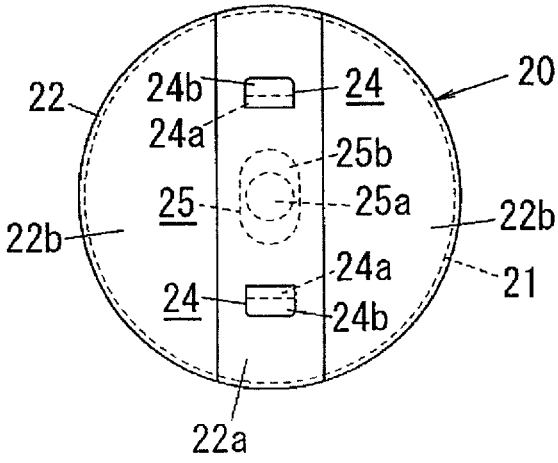
FIG. 3B is a side view of the straight tube lamp with a lamp pin of a second end cap projected on a first end cap.

On the end surface of the first end cap 22 of the straight tube lamp 20, there are provided recess portions 22*b* depressed in a substantially semicircular shape (see FIG. 3B). When seen in a side view, the recess portions 22*b* are formed at the opposite sides of a radial center portion of the first end cap 22. The center portion becomes a rectangular raised portion 22*a* protruding forward beyond the recess portions 22*b*. Two first lamp pins 24 as power-feeding lamp pins are provided on the raised portion 22*a* in a substantially parallel relationship with each other. The first lamp pins 24 are arranged symmetrically with respect to the center axis (not shown) of the cylindrical light emitting tube 21 interposed therebetween. The first lamp pins 24 are formed into a plate-like shape by a metallic material. The first lamp pins 24 protrude along the axial direction of the straight tube lamp 20. Each of the first lamp pins 24 includes a plate-like projection portion 24*a* protruding parallel to the axial direction of the straight tube lamp 20 and a bent portion 24*b* bent substantially at a right angle with respect to the plate-like projection portion 24*a* to protrude outward away from the center axis.

Within the light emitting tube 21, the first lamp pins 24 are electrically connected to the circuit pattern of the mounting substrate through lead wires not shown in the drawings. The light emitting diodes are mounted on the mounting substrate. In addition, circuit parts (not shown), such as a full-wave rectifier for electrically protecting the light emitting diodes, are mounted on the mounting substrate. In other words, the straight tube lamp 20 has a structure in which the first lamp pins 24 and the light emitting diodes are electrically connected to each other through the full-wave rectifier so that a forward current can flow through the light emitting diodes even when one of the first lamp pins 24 is connected to a positive electrode of an external DC power supply through the waterproof socket 10. Thus the first lamp pins 24 serve as terminals for feeding electric power to the light emitting diodes of the straight tube lamp 20.

While not shown in the drawings, each of the light emitting diodes arranged within the straight tube lamp 20 includes an LED chip for, when energized, emitting blue light whose peak wavelength is in a range of from 420 nm to 490 nm and a package body made of ceramic (e.g., alumina) and provided with a storage recess portion for storing the LED chip. A wavelength converting member is embedded in the storage recess portion. The wavelength converting member is made of a light-transmitting material (e.g., silicon resin, epoxy resin, acryl resin, polycarbonate resin or glass) containing a fluorescent substance (e.g., an aluminate-based fluorescent substance such as $Y_3Al_5O_{12}$ activated by cerium or $Tb_3Al_5O_{12}$ activated by cerium, or a silicate-based fluorescent substance such as $Ba_2SiO_4$ activated by europium). The fluorescent substance absorbs a portion of the blue light emitted from the LED chip and generates fluorescent light (e.g., yellow light) having a longer wavelength. Each of the light emitting diode includes an external connection electrode (not shown) arranged on the other surface of the package body. The external connection electrode and the circuit pattern of the mounting substrate are electrically connected to each other through a junction portion (not shown) formed by soldering.

The second end cap 23 as the other end cap of the straight tube lamp 20 includes a second lamp pin 25 as a grounding lamp pin protruding from the second end cap 23 along the axial direction of the straight tube lamp 20. The second lamp pin 25 includes a shaft portion 25*a* protruding from the center of the end surface of the second end cap 23 in the axial direction of the straight tube lamp 20. The shaft portion 25*a* is formed into a circular rod shape by a metallic material. An increased diameter portion 25*b* having a diameter larger than the diameter of the shaft portion 25*a* is provided at the tip end of the shaft portion 25*a* (see FIG. 3B). The increased diameter portion 25*b* is formed into an elongated circular shape. When seen in the axial direction of the straight tube lamp 20, the longitudinal direction of the increased diameter portion 25*b* is parallel to the spaced-apart direction of the first lamp pins 24 protruding from the first end cap 22 of the straight tube lamp 20. The shape of the increased diameter portion 25*b* is not limited to the elongated circular shape but may be an elliptical shape. The increased diameter portion 25*b* is made of a metallic material and is one-piece formed with the shaft portion 25*a*. In other words, the second lamp pin 25 is formed into a T-like shape by the shaft portion 25*a* and the increased diameter portion 25*b* (see FIG. 3A). The second lamp pin 25 is electrically connected to the circuit pattern of the mounting substrate to serve as a grounding earth pin. In other words, the straight tube lamp 20 is of a one-side power-feeding type in which electric power is fed from the first end cap 22 existing at one end of the straight tube lamp 20.

The first end cap 22 of the straight tube lamp 20 can be mounted to the waterproof socket 10 of the present embodiment shown in FIG. 1. The first lamp pins 24 protruding from the first end cap 22 of the straight tube lamp 20 are inserted into an insertion hole le of a socket body 1. Then the straight tube lamp 20 is rotated about the center axis thereof, whereby the straight tube lamp 20 is mounted to the waterproof socket 10. The waterproof socket 10 includes a socket body 1, a tightening cover 6 configured to cover the first end cap 22 of the straight tube lamp 20 mounted to the socket body 1 and tightened to the socket body 1 by thread coupling, a first internal sleeve 3 making contact with the socket body 1, a tubular seal 4 for restraining moisture from infiltrating through between the straight tube lamp 20 and the tubular seal 4, and a second internal sleeve 5 for accommodating the seal 4 and pressing the seal 4 against the first internal sleeve 3 upon tightening the tightening cover 6. The first internal sleeve 3, the seal 4 and the second internal sleeve 5 are arranged between the socket body 1 and the tightening cover 6 in the named order from the socket body 1 toward the tightening cover 6, and the straight tube lamp 20 can be inserted through the second internal sleeve 5, the seal 4 and the first internal sleeve 3. The socket body 1 of the waterproof socket 10 includes body-side rotation restraint portions 1*g* engaging with sleeve-side rotation restraint portions 3*b*. The sleeve-side rotation restraint portions 3*b* are formed in the first internal sleeve 3 to restrain the first internal sleeve 3 from rotating about the center axis. The second internal sleeve 5 includes a second position restraint portion 5*c* engaging with a first position restraint portion 3*c* of the first internal sleeve 3 to restrain the second internal sleeve 5 from rotating about the center axis while allowing the second internal sleeve 5 to move in the axial direction of the straight tube lamp 20.

More specifically, the socket body 1 of the waterproof socket 10 of the present embodiment includes a hollow body portion 1*c* having an openings 1*ca* and a rotor 1*i* capable of rotating with respect to the body portion 1*c*. The rotor 1*i* is covered by the body portion 1*c* in the region other than the circumference of the openings 1*ca*. The socket body 1 further includes a pair of conductor portions 1*h* as power-feeding conductor plates arranged within a cavity surrounded by the body portion 1*c* and the rotor 1*i*. The conductor portions 1*h* can be electrically connected to the first lamp pins 24 of the straight tube lamp 20.

The socket body 1 includes a base portion 1*a* to be mounted to a device not shown in the drawings. The base portion 1*a* is connected to the body portion 1*c* through a support portion 1*b*. The body portion 1*c* is formed into a cylindrical closed-bottom shape by synthetic resin. The rotor 1*i* is made of synthetic resin. The rotor 1*i* has socket surfaces 1*ia* with which the recess portions 22*b* of the first end cap 22 of the straight tube lamp 20 can make contact. On the outer circumferential wall 1*d* of the body portion 1*c*, there is provided an insertion hole 1*e* for receiving the first lamp pins 24 protruding from the first end cap 22 of the straight tube lamp 20. The rotor 1*i* has a straight groove portion 1*kb* extending from the outer circumference of the rotor 1*i* along the radial direction of the rotor 1*i*. The first lamp pins 24 are inserted into the socket body 1 through the straight groove portion 1*kb*. The rotor 1*i* includes a cylindrical protrusion portion 1*k* that rotatably engages with a pair of semi-cylindrical salient portions 1*j* protruding from the central region of the inner bottom surface of the body portion 1*c*. The protrusion portion 1*k* protrudes toward the body portion 1*c* and has an inner diameter larger than the outer diameter of the salient portions 1*j*. The protrusion portion 1*k* of the rotor 1*i* has a claw portion 1*ka* engaging with insertion recess portions 1*ja* formed in the salient portions 1*j* (see FIG. 2). In other words, the rotor 1*i* can be rotated to align the straight groove portion 1*kb* with the insertion hole 1*e* on the outer circumferential wall 1*d*. The body portion 1*c* and the rotor 1*i* are formed by synthetic resin having an electric insulation property, thereby assuring electric insulation.

The conductor portions 1*h* are formed by bending a plate-like body made of a metallic material (e.g., copper alloy) having increased electric conductivity. The conductor portions 1*h* are arranged within the body portion 1*c* with the salient portions 1*j* interposed therebetween. The conductor portions 1*h* may be formed into an identical shape or different shapes. In this regard, the conductor portions 1*h* are fixed in place using inner wall portions 1*m* arranged inside the body portion 1*c*.

Each of the conductor portions 1*h* includes a contact piece 1*ha* formed in the central portion thereof to make contact with each of the first lamp pins 24 of the straight tube lamp 20. Each of the conductor portions 1*h* further includes a guide piece 1*hb* formed in one end portion of the contact piece 1*ha*. The guide piece 1*hb* is bent from the contact piece 1*ha* in such a direction that the spacing between the guide pieces 1*hb* becomes wider than the spacing between the contact pieces 1*ha*. Each of the conductor portions 1*h* further includes a base piece 1*hc* formed at the opposite side of the contact piece 1*ha* from the guide piece 1*hb*.

In the waterproof socket 10 holding the straight tube lamp 20, the contact piece 1*ha* of each of the conductor portions 1*h* arranged within the body portion 1*c* makes contact with each of the first lamp pins 24 of the straight tube lamp 20 in a state that the recess portions 22*b* of the straight tube lamp 20 are brought into contact with the socket surfaces 1*ia* of the rotor 1*i*. When the straight tube lamp 20 is mounted to the waterproof socket 10, the plate-like projection portion 24*a* of each of the first lamp pins 24 comes into elastic contact with the contact piece 1*ha* of each of the conductor portions 1*h*, whereby the first lamp pins 24 are held within the waterproof socket 10. After each of the first lamp pins 24 is inserted into the insertion hole le along the straight groove portion 1*kb*, the straight tube lamp 20 is rotated about the center axis thereof, whereby the insertion hole le of the body portion 1*c* and the straight groove portion 1*kb* of the rotor 1*i* get out of alignment with each other. Thus the plate-like projection portion 24*a* of each of the first lamp pins 24 is held in place by the contact piece 1*ha* of each of the conductor portions 1*h* and is prevented from being removed from the waterproof socket 10.

The socket body 1 has a plurality of (two, in the present embodiment) through-holes (not shown) extending from the base portion 1*a* to the body portion 1*c* through the support portion 1*b*. The through-holes of the base portion la serve as insertion holes for receiving electric wires (not shown) electrically connectable to the conductor portions 1*h*. Each of the conductor portions 1*h* may be configured to have a quick-connection terminal (not shown) so that the conductor portions 1*h* and the electric wires can be readily connected to each other. Attachment grooves 1*aa* to be engaged with a device for attachment of the waterproof socket 10 are appropriately formed on the opposite side surfaces of the base portion 1*a* of the socket body 1.

The socket body 1 includes a male thread if formed on the outer circumferential surface of the outer circumferential wall 1*d* of the body portion 1*c*. An annular groove 1*cd* for receiving a flange portion 2*b* of an annular waterproof packing 2 is formed on the inner bottom surface of the body portion 1*c* (see FIG. 2). In this regard, the waterproof socket 10 of the present embodiment includes a tightening cover 6 configured to cover the first end cap 22 of the straight tube lamp 20 mounted to the socket body 1 and tightened to the socket body 1 by the thread coupling with the male thread 1*f* of the body portion 1*c*.

Figure 1B:
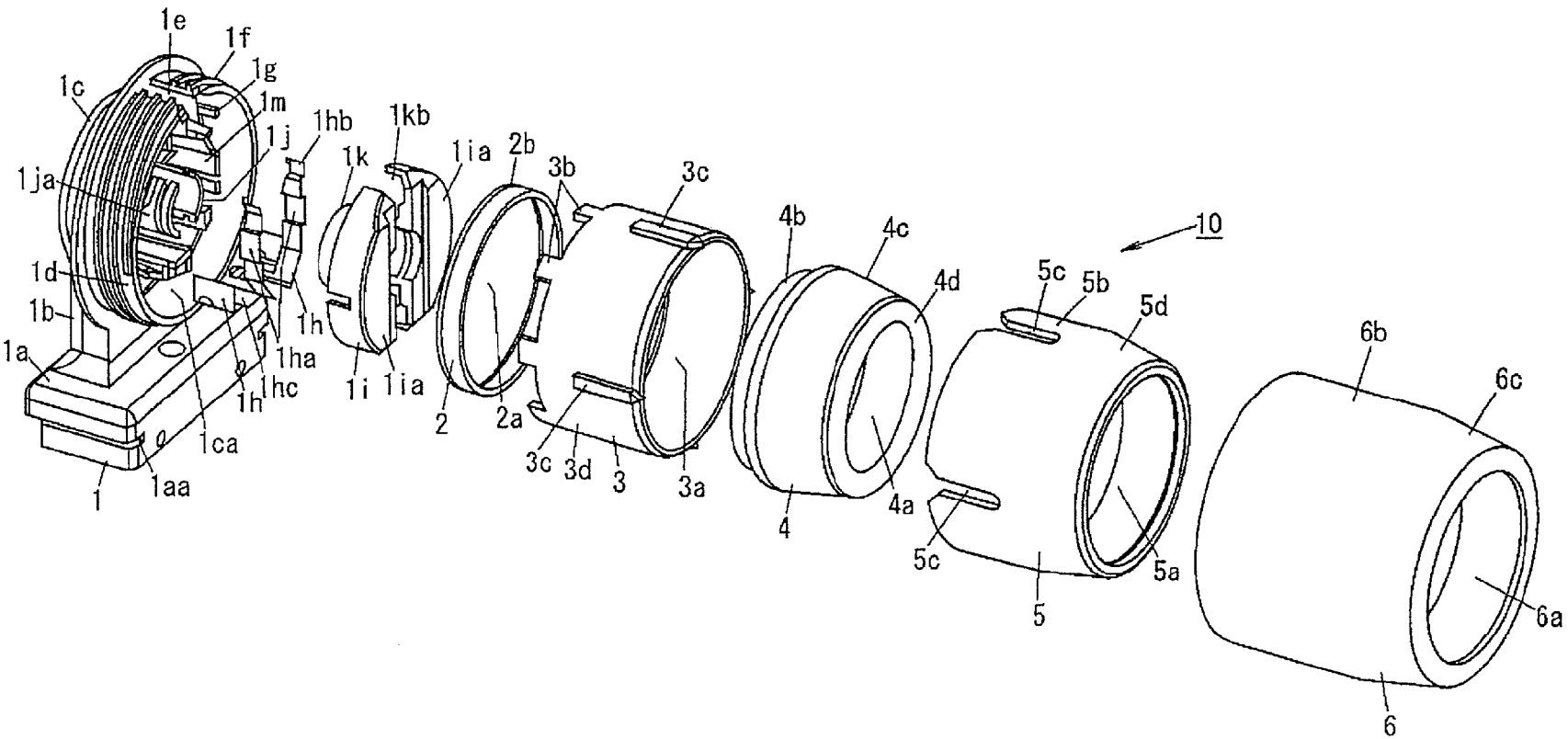
FIG. 1B is an exploded perspective view of the waterproof socket of the first embodiment.

As shown in FIG. 1B, the waterproof socket 10 of the present embodiment includes an annular waterproof packing 2, a cylindrical first internal sleeve 3 making contact with the socket body 1, a cylindrical seal 4 for restraining moisture from infiltrating through between the straight tube lamp 20 and the cylindrical seal 4, and an annular second internal sleeve 5 for accommodating the seal 4 and pressing the seal 4 against the first internal sleeve 3 upon tightening the tightening cover 6. The waterproof packing 2, the first internal sleeve 3, the seal 4 and the second internal sleeve 5 are arranged between the socket body 1 and the tightening cover 6 in the named order from the socket body 1 toward the tightening cover 6. The tightening cover 6 is formed into a cylindrical shape by synthetic resin. The tightening cover 6 has a cover opening 6*a* whose inner diameter is set a little larger than the outer diameter of the first end cap 22 so that the first end cap 22 of the straight tube lamp 20 can be inserted into the cover opening 6*a*. The tightening cover 6 has a female thread 6*d* formed on the inner circumferential surface thereof (see FIG. 2). The female thread 6*d* is threadedly coupled to the male thread if of the socket body 1. By rotating the tightening cover 6 about the center axis of the straight tube lamp 20 and threadedly coupling the female thread 6*d* with the male thread lf, the tightening cover 6 can be removably attached to the socket body 1 so as to cover the outer circumferential surface of the first end cap 22 of the straight tube lamp 20 mounted to the socket body 1. The tightening cover 6 includes a cover body portion 6*b* existing at the side of the body portion 1*c* of the socket body 1 and a cover slant portion 6*c* formed such that the inner diameter of the cover opening 6*a* becomes smaller as the cover slant portion 6*c* extends away from the cover body portion 6*b* toward the opposite side of the body portion 1*c*. The tightening cover 6 accommodates the annular seal 4 made of an elastic material so that the tightening cover 6 can press the seal 4 against the first internal sleeve 3 through the second internal sleeve 5.

The second internal sleeve 5 includes a second internal sleeve body portion 5*b* existing at the side of the body portion 1*c* of the socket body 1 and a second internal sleeve slant portion 5*d* formed such that the inner diameter of a second internal sleeve opening 5*a* becomes smaller as the second internal sleeve slant portion 5*d* extends away from the second internal sleeve body portion 5*b* toward the opposite side of the body portion 1*c*. The cylindrical second internal sleeve 5 has an inner diameter which is set a little larger than the outer diameter of the first end cap 22 but smaller than the inner diameter of the cover opening 6*a* so that the first end cap 22 of the straight tube lamp 20 can be inserted into the second internal sleeve opening 5*a*.

Figure 2:
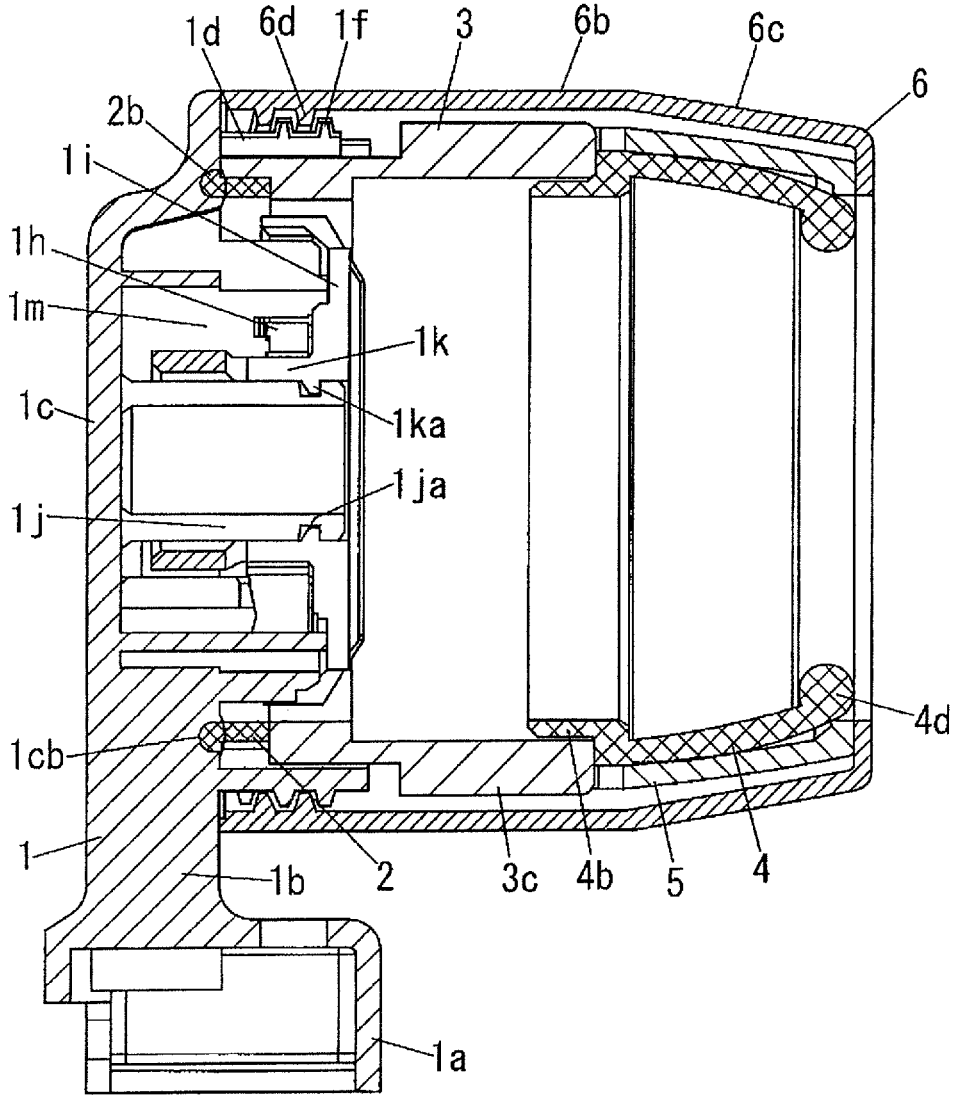
FIG. 2 is a vertical section view of the waterproof socket of the first embodiment.

The seal 4 accommodated within the second internal sleeve 5 is arranged inside the second internal sleeve 5 and the first internal sleeve 3 so as to straddle the second internal sleeve 5 made of synthetic resin and the first internal sleeve 3 made of synthetic resin (see FIG. 2). The seal 4 includes a seal body portion 4*c* and a cylindrical seal contact portion 4*b* arranged at the side of the body portion 1*c*. The seal contact portion 4*b* has an outer diameter smaller than the outer diameter of the seal body portion 4*c* and makes contact with the first internal sleeve 3. The seal body portion 4*c* is tapered such that the inner diameter of the seal opening 4*a* becomes smaller toward the opposite side of the body portion 1*c*. The seal body portion 4*c* has an annular seal close-contact portion 4*d* formed at one end thereof so as to make close contact with the straight tube lamp 20 inserted. The cylindrical seal 4 has an inner diameter which is set a little larger than the outer diameter of the first end cap 22 but smaller than the inner diameter of the second internal sleeve opening 5*a* so that the first end cap 22 of the straight tube lamp 20 can be inserted into the seal opening 4*a*.

The first internal sleeve 3 includes a cylindrical first internal sleeve body portion 3*d* having an inner diameter which is set a little larger than the outer diameter of the first end cap 22 so that the first end cap 22 of the straight tube lamp 20 can be inserted into the first internal sleeve opening 3*a*. The inner diameter of the first internal sleeve body portion 3*d* is set such that the first internal sleeve body portion 3*d* can accommodate and make contact with the seal contact portion 4*b*.

In the waterproof socket 10 of the present embodiment, as can be seen from the section view shown in FIG. 2, the first internal sleeve 3 and the second internal sleeve 5 are arranged between the tightening cover 6 and the seal 4 making close contact with the straight tube lamp 20 inserted. The first internal sleeve 3 and the second internal sleeve 5 are arranged on the outer circumferential surface of the elastically deformable seal 4. The inner circumferential surface of the seal 4 can make close contact with the straight tube lamp 20.

The tightening cover 6 is threadedly coupled to the body portion 1*c*, whereby the cover slant portion 6*c* reduces the inner diameter of the seal opening 4*a* of the seal 4 through the second internal sleeve 5 and presses the seal close-contact portion 4*d* so as to make close contact with the straight tube lamp 20. The second internal sleeve 5 is made of a synthetic resin material smaller in tackiness and frictional coefficient than the seal 4. Similarly, the first internal sleeve 3 is made of a synthetic resin material smaller in tackiness and frictional coefficient than the seal 4.

As compared with a waterproof socket having a structure in which the tightening cover 6 and the seal 4 make direct contact with each other, the waterproof socket 10 of the present embodiment has an advantage in that, when the tightening cover 6 is tightened to the body portion 1*c* by rotating the same about the center axis, it is possible to easily rotate the tightening cover 6 with respect to the body portion 1*c* while maintaining the close contact between the straight tube lamp 20 and the seal 4.

In order to prevent the co-rotation by which the straight tube lamp 20 is rotated together with the tightening cover 6, the first internal sleeve 3 includes a plurality of raised sleeve-side rotation restraint portions 3*b* protruding from one end of the first internal sleeve body portion 3*d* toward the body portion 1*c*. In other words, the first internal sleeve 3 includes sleeve-side rotation restraint portions 3*b* for restraining the first internal sleeve 3 from rotating about the center axis of the straight tube lamp 20. The socket body 1 includes a plurality of recessed body-side rotation restraint portions 1*g* protruding from the inner surface of the outer circumferential wall 1*d* of the body portion 1*c* and engaging with the sleeve-side rotation restraint portions 3*b* of the first internal sleeve 3.

In this regard, the sleeve-side rotation restraint portions 3*b* and the body-side rotation restraint portions 1*g* may have any shape insofar as they can engage with each other to restrain rotation of the first internal sleeve 3. For example, the body-side rotation restraint portions 1*g* may have a raised shape and the sleeve-side rotation restraint portions 3*b* may have a recessed shape so as to engage with the body-side rotation restraint portions 1*g* having a raised shape.

In order to restrain the straight tube lamp 20 from rotating together with the tightening cover 6, the first internal sleeve 3 includes a plurality of first position restraint portions 3*c*. The first position restraint portions 3*c* are raised portions and are formed into an outwardly-protruding rectangular solid shape extending along the axial direction of the straight tube lamp 20.

The second internal sleeve 5 is movable with respect to the first internal sleeve 3 in the axial direction of the straight tube lamp 20. The second internal sleeve 5 engages with the first position restraint portions 3*c*, i.e., the raised portions, of the first internal sleeve 3 so that the second internal sleeve 5 can be restrained from rotating about the center axis of the straight tube lamp 20. For this purpose, the second internal sleeve 5 includes a plurality of second position restraint portions 5*c* as cutout portions extending along the axial direction of the straight tube lamp 20 from the end of the second internal sleeve body portion 5*b* facing the body portion 1*c*. The second position restraint portions 5*c* are formed along the outer circumference of the second internal sleeve 5.

In the waterproof socket 10 of the present embodiment, when the tightening cover 6 is tightened to the body portion 1*c* by rotating the same about the center axis, it is possible to threadedly couple the tightening cover 6 to the body portion 1*c* while restraining the co-rotation of the straight tube lamp 20.

The first position restraint portions 3*c* are not limited to the raised portions set forth above and the second position restraint portions 5*c* are not limited to the cutout portions set forth above. Alternatively, one of the first position restraint portions 3*c* and the second position restraint portions 5*c* may be raised portions and the other may be cutout portions or groove portions engaging with the raised portions. The waterproof packing 2 and the first internal sleeve 3 are not necessarily provided in the waterproof socket 10 as long as the second internal sleeve 5 is capable of preventing the co-rotation of the straight tube lamp 20 and the body portion 1*c* is shaped to allow the second internal sleeve 5 to move along the axial direction of the straight tube lamp 20. In this case, the waterproof socket 10 may be configured to include, e.g., an annular protrusion portion protruding from the body portion 1*c* to engage with the second internal sleeve 5. In the present embodiment, however, the waterproof socket 10 is configured to include the waterproof packing 2 and the first internal sleeve 3. With the waterproof socket 10 of this configuration, it is possible to easily attach and detach the straight tube lamp as compared with a configuration having an annular protrusion portion (not shown).

While not shown in the drawings, the waterproof socket for holding the second end cap 23 of the straight tube lamp has substantially the same external shape as the waterproof socket 10 for holding the first end cap 22 of the straight tube lamp 20. The waterproof socket for holding the second end cap 23 has a socket surface with which the second end cap 23 of the straight tube lamp 20 can make contact. The waterproof socket for holding the second end cap 23 can be configured to have a groove formed on the socket surface. The second lamp pin 25 of the straight tube lamp 20 is inserted into the groove. The groove is capable of holding the shaft portion 25*a* of the second lamp pin 25 so that the shaft portion 25*a* can rotate about the center axis of the straight tube lamp 20. Alternatively, the waterproof socket may be configured to have a straight groove extending from the outer circumferential wall 1*d* of a socket body toward the center of the socket body. The straight groove is capable of holding the shaft portion 25*a* of the second lamp pin 25 so that the shaft portion 25*a* can rotate about the center axis of the straight tube lamp 20. In this regard, the portion of the straight groove existing on the outer circumferential wall of the socket body becomes an insertion hole for receiving the second lamp pin 25 protruding from the second end cap 23 of the straight tube lamp 20. The waterproof socket for holding the second end cap 23 includes a second conductor plate as a grounding conductor plate arranged inside the waterproof socket. The second conductor plate makes up a conductor portion electrically connectable to the second lamp pin 25 protruding from the second end cap 23. The second conductor plate is electrically connected to the second lamp pin 25 as a grounding earth pin. The second conductor plate can serve as a grounding earth terminal. The second conductor plate is electrically connected an object outside the waterproof socket for grounding purposes. Alternatively, the second conductor plate may be used to merely hold the second lamp pin 25. Just like the waterproof socket 10 for holding the first end cap 22, the waterproof socket for holding the second end cap 23 covers the second end cap 23 of the straight tube lamp 20 and includes a first internal sleeve, a seal and a second internal sleeve. When the tightening cover is threadedly coupled to the socket body about the center axis of the straight tube lamp 20, the first internal sleeve, the seal and the second internal sleeve are arranged between the socket body and the tightening cover in the named order from the socket body toward the tightening cover. The socket body of the waterproof socket for holding the second end cap 23 includes a body-side rotation restraint portion engaging with a sleeve-side rotation restraint portion. The second internal sleeve includes a second position restraint portion engaging with a first position restraint portion of the first internal sleeve. The first position restraint portion and the second position restraint portion restrain the second internal sleeve from rotating with respect to the first internal sleeve in the rotating direction of the straight tube lamp 20 while allowing the second internal sleeve to move along the axial direction of the straight tube lamp 20. In other words, the waterproof socket for holding the second end cap 23 of the straight tube lamp 20 is structurally the same as the waterproof socket 10 for holding the first end cap 22 of the straight tube lamp 20, except the structure for holding the second end cap 23 of the straight tube lamp 20.

Next, description will be made on a method of mounting the straight tube lamp 20 to the waterproof socket 10 of the present embodiment to obtain a waterproof structure.

When mounting the straight tube lamp 20 to the waterproof socket 10, the straight tube lamp 20 is first inserted into the packing opening 2*a* of the waterproof packing 2, the first internal sleeve opening 3*a* of the first internal sleeve 3, the seal opening 4*a* of the seal 4, the second internal sleeve opening 5*a* of the second internal sleeve 5 and the cover opening 6*a* of the tightening cover 6.

Then, the first end cap 22 of the straight tube lamp 20 is positioned at the side of the socket surface 1*ia* of the waterproof socket 10 and the second end cap 23 of the straight tube lamp 20 is positioned at the side of the socket surface of the waterproof socket for holding the second end cap 23. In this state, the straight tube lamp 20 is moved toward the waterproof socket 10. Then, the first lamp pins 24 of the first end cap 22 are inserted into the insertion hole 1*e* of the waterproof socket 10. Similarly, the second lamp pin 25 of the second end cap 23 is inserted into the second insertion hole of the second socket surface of the waterproof socket for the second end cap 23. Thereafter, the straight tube lamp 20 is rotated about the center axis thereof with respect to the waterproof socket 10, whereby the straight tube lamp 20 is mounted to the waterproof socket 10.

As a consequence, each of the first lamp pins 24 is inserted into the socket body 1 through the insertion hole 1*e* and is fitted to the contact piece 1*ha* of the conductor portion 1*h* while rotating the rotor 1*i*.

As the plate-like projection portion 24*a* of each of the first lamp pins 24 is inserted into the insertion hole 1*e*, the contact piece 1*ha* of the conductor portion 1*h* is bent outward. Thereafter, the plate-like projection portion 24*a* is kept in contact with the contact piece 1*ha* by the elastic force of the contact piece 1*ha*.

In the waterproof socket 10, the contact pieces 1*ha* of the conductor portions 1*h* are electrically connected to the first lamp pins 24 of the straight tube lamp 20. At the same time, the contact pieces 1*ha* mechanically hold the straight tube lamp 20.

In this state, the positional relationship between the mounting substrate and the first lamp pins 24 or the second lamp pin 25 is set so that the light emitting diodes existing within the light emitting tube 21 can face a specified irradiation surface. At this time, the first lamp pins 24 are electrically connected to the conductor portions 1*h* arranged within the body portion 1*c* of the waterproof socket 10. Consequently, the waterproof socket 10 can supply a DC current to the light emitting diodes of the straight tube lamp 20 through the conductor portions 1*h*. The increased diameter portion 25*b* of the second lamp pin 25 of the straight tube lamp 20 is electrically connected to the second conductor plate. Thus the second lamp pin 25 serves as a grounding earth pin. In other words, the waterproof socket for the second end cap 23 can hold the second end cap 23 of the straight tube lamp 20 and can perform the earth connection of the straight tube lamp 20.

Next, the waterproof packing 2, the first internal sleeve 3, the seal 4, the second internal sleeve 5 and the tightening cover 6, through which the straight tube lamp 20 is inserted, are moved toward the socket body 1. The flange portion 2*b* of the waterproof packing 2 is fitted to the annular groove 1*cd*. The outer circumference of the waterproof packing 2 is brought into contact with the first internal sleeve opening 3*a*. The sleeve-side rotation restraint portions 3*b* of the first internal sleeve 3 are caused to engage with the body-side rotation restraint portions 1*g* of the socket body 1. The seal contact portion 4*b* of the seal 4 is received within the first internal sleeve opening 3*a* and is brought into contact with the end of the first internal sleeve body portion 3*d* of the first internal sleeve 3. The second internal sleeve 5 covers and accommodates the seal 4. The tightening cover 6 covers the second internal sleeve 5. The position restraint portions 5*c* of the second internal sleeve 5 as cutout portions are fitted to the position restraint portions 3*c* of the first internal sleeve 3 as raised portions. In this state, the tightening cover 6 covering the waterproof packing 2, the first internal sleeve 3, the seal 4 and the second internal sleeve 5, through which the straight tube lamp 20 is inserted, is threadedly coupled to the socket body 1 of the waterproof socket 10. At this time, the straight tube lamp 20 is mounted so that the light emitting diodes can face a specified irradiation surface.

In the waterproof socket 10 of the present embodiment, the rotation restraint portions 1*g* of the socket body 1 engage with the rotation restraint portions 3*b* of the first internal sleeve 3. It is therefore possible to restrain the first internal sleeve 3 from rotating with respect to the socket body 1 about the center axis of the straight tube lamp 20. Since the first position restraint portions 3*c* and the second position restraint portions 5*c* engage with each other, it is possible to, when tightening the tightening cover 6, prevent the first internal sleeve 3 and the second internal sleeve 5 from rotating with respect to the socket body 1 about the center axis of the straight tube lamp 20.

In the waterproof socket 10 of the present embodiment, it is therefore possible to restrain the straight tube lamp 20 from rotating together with the tightening cover 6. This makes it possible to mount the straight tube lamp 20 in a state that the insertion direction of the straight tube lamp 20 with respect to the waterproof socket 10 is fixed to a specified direction. In other words, the waterproof socket of the present embodiment is capable of restraining unintentional rotation of the straight tube lamp 20.

While the one-side power-feeding type straight tube lamp provided with an L-type end cap is employed as the straight tube lamp 20 in the waterproof socket 10 of the present embodiment described above, the waterproof socket 10 may be used to hold a double-side power-feeding type straight tube lamp. In other words, the waterproof socket 10 may be used to hold not only a one-side power-feeding type straight tube lamp but also a double-side power-feeding type straight tube lamp. In the latter case, electric power can be feed through the waterproof socket 10 making contact with the first end cap 22 attached to one end of the straight tube lamp 20 and the waterproof socket 10 making contact with the second end cap 23 attached to the other end of the straight tube lamp 20.

In the waterproof socket 10 of the present embodiment, the tightening cover 6 serves as a tightening part, the second internal sleeve 5 serving as a pressing part for compressing the seal 4, the seal 4 serving as a part for restraining infiltration of moisture, and the first internal sleeve 3 serving as a co-rotation preventing part. Accordingly, the waterproof socket 10 of the present embodiment is capable of preventing the straight tube lamp 20 from making co-rotation as the tightening cover 6 is tightened to the socket body 1.

(Second Embodiment)

The waterproof socket 10 of the present embodiment differs from the waterproof socket 10 of the first embodiment in that, as shown in FIG. 4, serrated sleeve-side rotation restraint portions 3*b* and serrated body-side rotation restraint portions 1*g* are used instead of the raised sleeve-side rotation restraint portions 3*b* and the recessed body-side rotation restraint portions 1*g* employed in the waterproof socket 10 of the first embodiment. Other configurations and functions remain the same as those of the first embodiment.

Figure 4A:
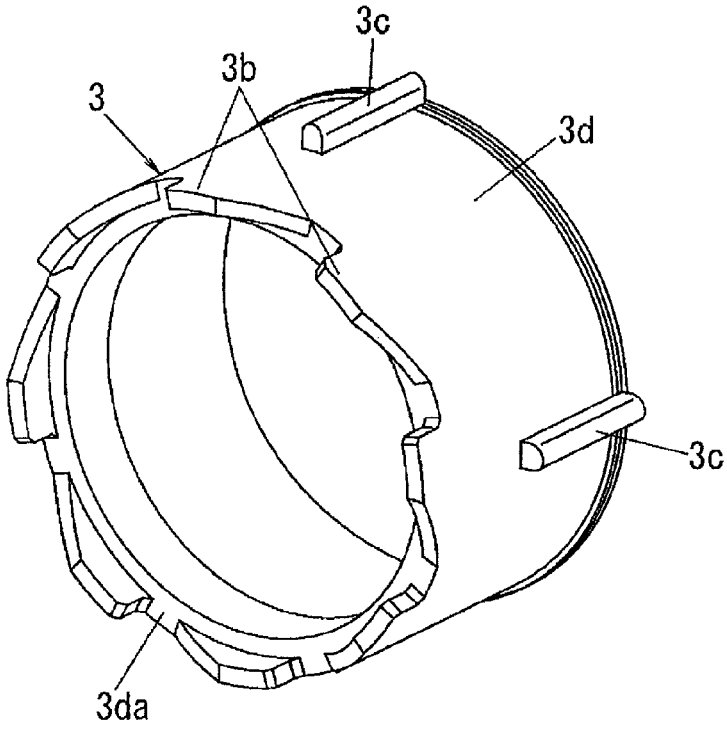
FIG. 4A is an external perspective view of a first internal sleeve of a waterproof socket according to a second embodiment of the present invention.
Figure 4B:
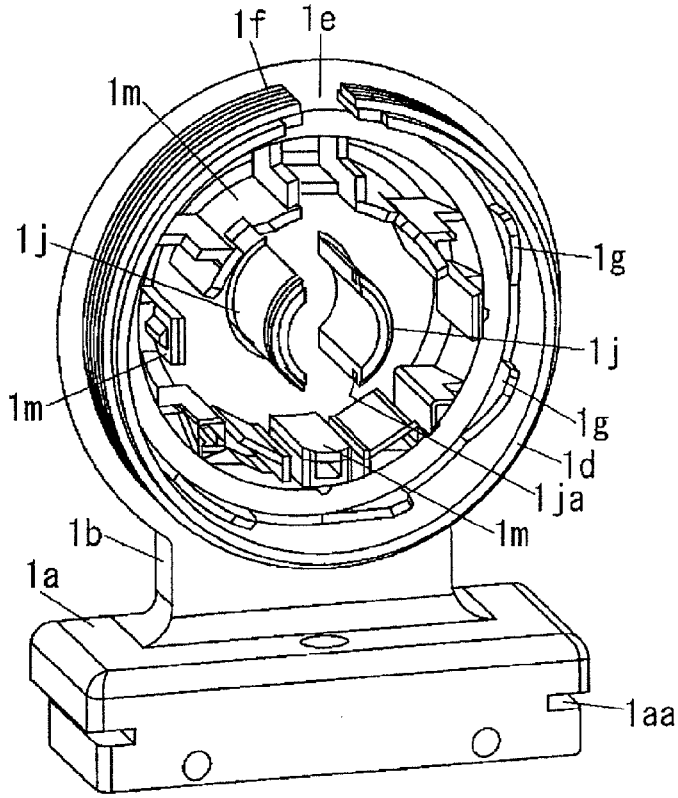
FIG. 4B is a perspective view of a socket body of the waterproof socket of the second embodiment.

As shown in FIG. 4A, the first internal sleeve 3 of the waterproof socket 10 of the present embodiment includes a plurality of (eight, in the present embodiment) serrated sleeve-side rotation restraint portions 3*b* protruding from one end of the first internal sleeve body portion 3*d* toward the body portion 1*c*. As depicted in FIG. 4B, the body portion 1*c* of the waterproof socket 10 of the present embodiment includes a plurality of (eight, in the present embodiment) serrated body-side rotation restraint portions 1*g* formed on the inner circumferential surface of the outer circumferential wall 1*d* to extend along the axial direction of the straight tube lamp 20. The body-side rotation restraint portions 1*g* allow the first internal sleeve 3 to rotate in one direction about the center axis of the straight tube lamp 20 but restrains the first internal sleeve 3 from rotating in the other direction opposite to said one direction.

The serrated sleeve-side rotation restraint portions 3*b* protrude from the end surface 3*da* of the first internal sleeve body portion 3*d* toward the body portion 1*c* along the outer circumference of the first internal sleeve body portion 3*d*. In this regard, the end surface 3*da* of the first internal sleeve body portion 3*d* has a size large enough to make contact with the flange portion 2*b* of the waterproof packing 2.

In the waterproof socket 10 of the present embodiment, the serrated sleeve-side rotation restraint portions 3*b* of the first internal sleeve 3 engage with the body-side rotation restraint portions 1*g* of the body portion is when mounting the straight tube lamp 20 to the socket body 1.

Since the sleeve-side rotation restraint portions 3*b* and the rotation restraint portions 1*g* have a mutually-engaging serrated shape, it is possible to restrain the first internal sleeve 3 from rotating in the tightening direction of the tightening cover 6. It is also possible to enable the sleeve-side rotation restraint portions 3*b* and the body-side rotation restraint portions 1*g* to be readily disengaged from each other when removing the tightening cover 6 from the socket body 1.

(Third Embodiment)

Figure 5:
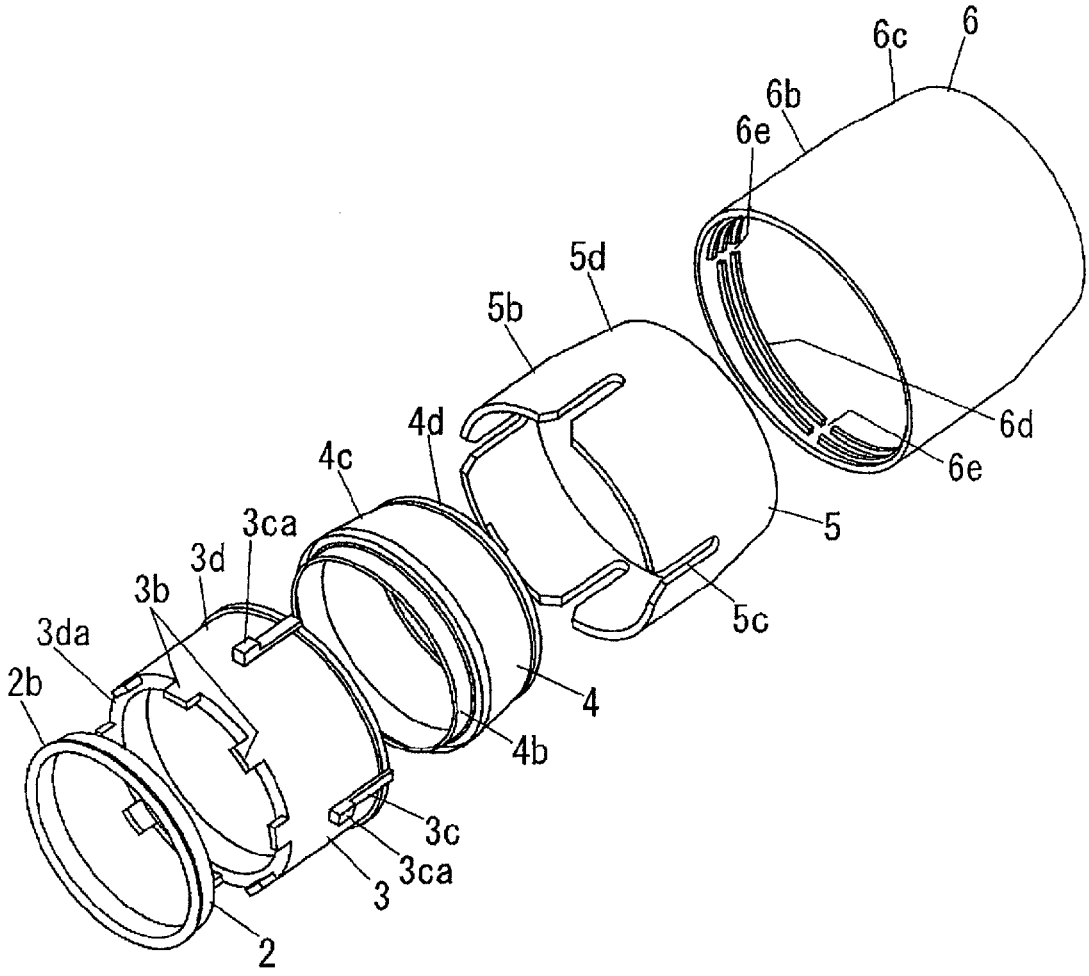
FIG. 5 is an exploded perspective view showing certain major parts of a waterproof socket according to a third embodiment of the present invention.

The waterproof socket 10 of the present embodiment shown in FIG. 5 differs from the waterproof socket 10 of the first embodiment in that lug portions 3*ca* are formed on the outer circumferential surface of the first internal sleeve 3. Other configurations and functions remain the same as those of the first embodiment.

As shown in FIG. 5, the tightening cover 6 of the waterproof socket 10 of the present embodiment includes a female thread 6*d* formed on the inner circumferential surface thereof and threadedly coupled to the socket body 1. Insertion passage portions 6*e* are formed in the female thread 6*d* to extend in the axial direction of the straight tube lamp 20. The first internal sleeve 3 includes lug portions 3*ca* protruding outward from the first position restraint portions 3*c* formed on the outer circumferential surface of the first internal sleeve 3. The lug portions 3*ca* can pass through the insertion passage portions 6*e* in the axial direction of the straight tube lamp 20. In the waterproof socket 10, the lug portions 3*ca* can be locked to the female thread 6*d* in the positions where the lug portions 3*ca* inserted through the insertion passage portions 6*e* get out of alignment with the insertion passage portions 6*e* in a circumferential direction about the center axis of the straight tube lamp 20.

In the waterproof socket 10 of the present embodiment, if the lug portions 3*ca* is inserted through the insertion passage portions 6*e* and is rotated to get out of alignment with the insertion passage portions 6*e* about the center axis of the straight tube lamp 20, it is possible to prevent the tightening cover 6 and the first internal sleeve 3 from being readily detached from each other. In the waterproof socket 10 of the present embodiment, therefore, the first internal sleeve 3 can be arranged within the tightening cover 6 while keeping the seal 4 and the second internal sleeve 5 positioned between the tightening cover 6 and the first internal sleeve 3. With the waterproof socket 10 of the present embodiment, it is easy to tighten the tightening cover 6 to the socket body 1. It is also easy to mount the straight tube lamp 20 in a waterproof manner.

The insertion passage portions 6*e* of the waterproof socket 10 of the present embodiment may have a constant width or a width growing smaller away from the socket body 1.

The insertion passage portions 6*e* with a width growing smaller away from the socket body 1 makes it easy to insert the lug portions 3*ca* into the insertion passage portions 6*e* and makes it difficult for the first internal sleeve 3 from being removed from the tightening cover 6.

In the waterproof socket 10 of the present embodiment, the circumferential interval between the insertion passage portions 6*e* and the circumferential interval between the lug portions 3*ca* may be set equal about the center axis of straight tube lamp 20. Alternatively, the circumferential interval between the insertion passage portions 6*e* and the circumferential interval between the lug portions 3*ca* may be set different about the center axis of straight tube lamp 20. The insertion passage portions 6*e* with different intervals make it more difficult to remove the first internal sleeve 3 from the tightening cover 6.

(Fourth Embodiment)

A waterproof socket packing 54 according to a fourth embodiment and a waterproof socket 10' provided with the waterproof socket packing 54 will be described with reference to FIGS. 6 through 10. A straight tube lamp 20 will be described with reference to FIG. 3. Throughout the respective figures, identical components will be designated by like reference symbols with no repeated description made thereon.

Figure 6A:
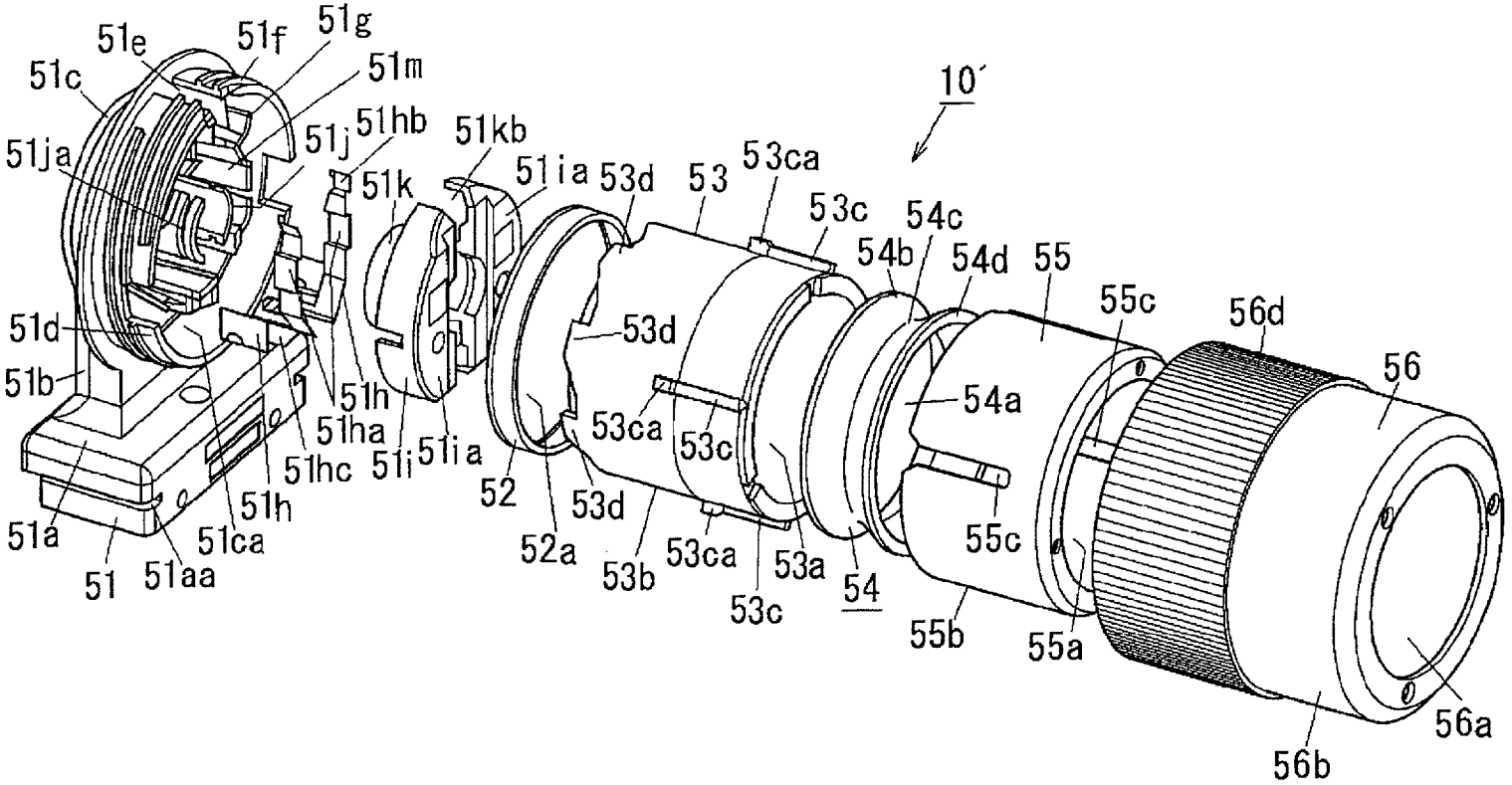
FIG. 6A is an exploded perspective view showing a waterproof socket employing a waterproof socket packing according to a fourth embodiment of the present invention.
Figure 6B:
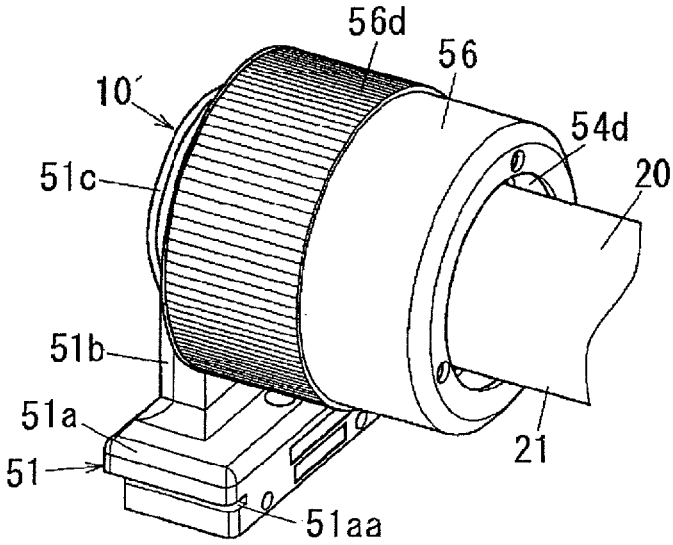
FIG. 6B is a schematic perspective view showing a use state in which a straight tube lamp is mounted to the waterproof socket shown in FIG. 6A.
Figure 7C:
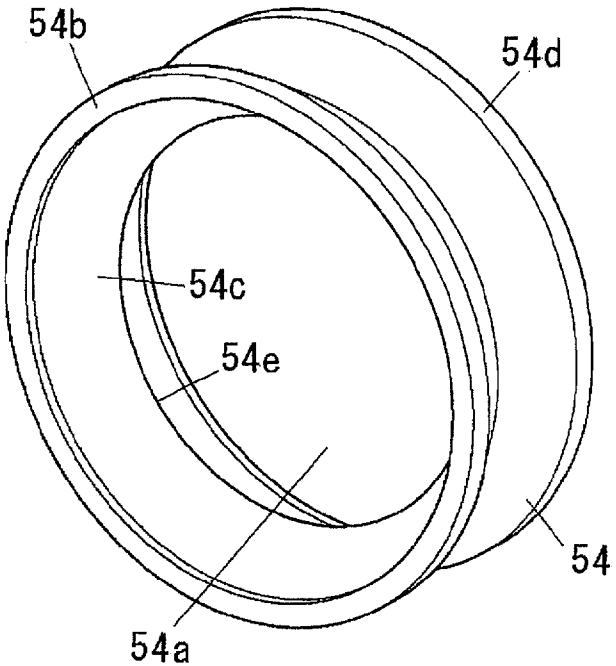
FIG. 7C is a schematic perspective view thereof.
Figure 7B:
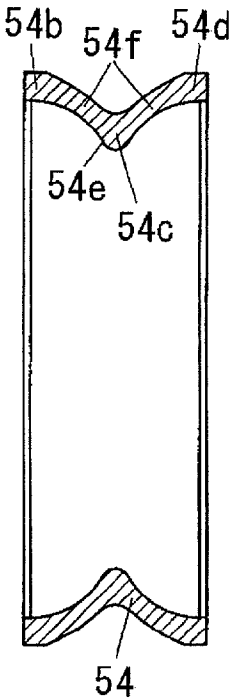
FIG. 7B is a section view thereof.
Figure 7A:
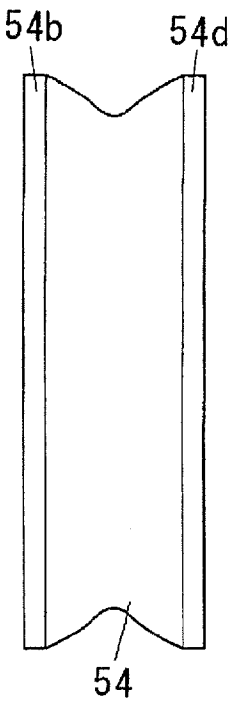
FIG. 7A is a side view showing the waterproof socket packing of the fourth embodiment kept in a non-compression state.
Figure 8C:
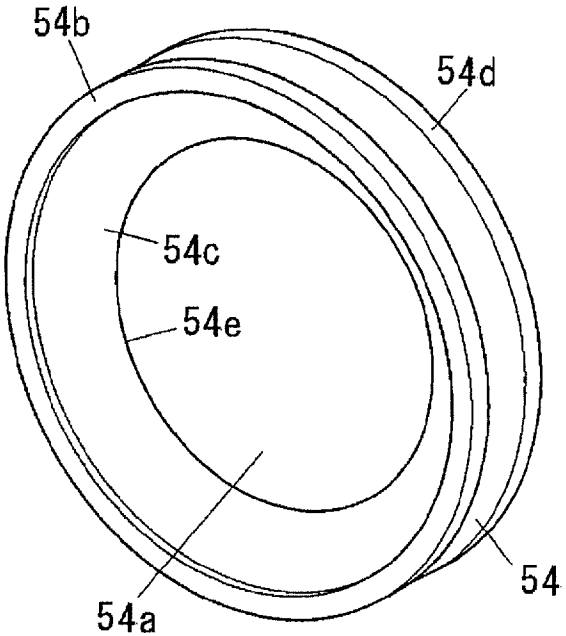
FIG. 8C is a schematic perspective view thereof.
Figure 8B:
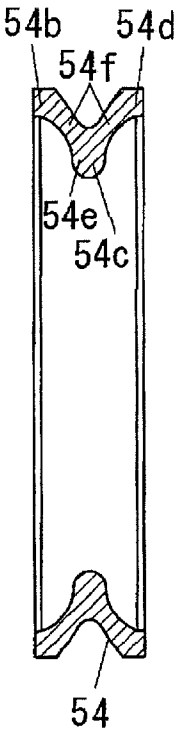
FIG. 8B is a section view thereof.
Figure 8A:
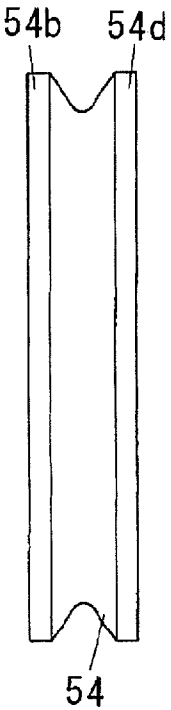
FIG. 8A is a side view showing the waterproof socket packing of the fourth embodiment kept in a compressed state.

The waterproof socket 10' shown in FIG. 6 is capable of holding the first end cap 22 of the straight tube lamp 20. In this waterproof socket 10', the first lamp pins 24 protruding from the first end cap 22 are inserted into an insertion hole le of a socket body 51. The straight tube lamp 20 is rotated about the center axis thereof and is mounted to the waterproof socket 10'. The waterproof socket 10' includes a socket body 51 and a tightening cover 56 configured to cover the first end cap 22 of the straight tube lamp 20 mounted to the socket body 51 and tightened to the socket body 51 by thread coupling. The waterproof socket 10' further includes the packing 54 through which the straight tube lamp 20 can be inserted. The packing 54 is arranged between the socket body 51 and the tightening cover 56 to prevent moisture from infiltrating through between the packing 54 and the straight tube lamp 20.

In this regard, the packing 54 includes a first contact portion 54*b* making contact with the socket body 51 and a second contact portion 54*d* making contact with the tightening cover 56. The packing 54 further includes a close-contact portion 54*c* arranged between the first contact portion 54*b* and the second contact portion 54*d*. The close-contact portion 54*c* is one-piece formed with the first contact portion 54*b* and the second contact portion 54*d* and is configured to make close contact with the light emitting tube 21 of the straight tube lamp 20. The outer circumferences of the packing 54 extending from the close-contact portion 54*c* to the first contact portion 54*b* and extending from the close-contact portion 54*c* to the second contact portion 54*d* along the axial direction of the straight tube lamp 20 are formed into an outwardly-bulging curved surface shape. In the packing opening 54*a* through which the first end cap 22 of the straight tube lamp 20 is inserted, the inner diameter of the first contact portion 54*b* and the inner diameter of the second contact portion 54*d* are set larger than the inner diameter of the close-contact portion 54*c*.

More specifically, the socket body 51 of the waterproof socket 10' employing the packing 54 of the present embodiment includes a hollow body portion 51*c* having an opening 51*ca* and a rotor 51*i* capable of rotating with respect to the body portion 51*c*. The rotor 51*i* is covered by the body portion 51*c* in the region other than the circumference of the opening 51*ca*. The socket body 51 further includes a pair of conductor portions 51*h* as power-feeding conductor plates arranged within a cavity surrounded by the body portion 51*c* and the rotor 51*i*. The conductor portions 51*h* can be electrically connected to the first lamp pins 24 of the straight tube lamp 20.

The socket body 51 includes a base portion 51*a* to be mounted to a device not shown in the drawings. The base portion 51*a* is connected to the body portion 51*c* through a support portion 51*b*. The body portion 51*c* is formed into a cylindrical closed-bottom shape by synthetic resin. The rotor 51*i* is made of synthetic resin. The rotor 1*i* has socket surfaces 51*ia* with which the recess portions 22*b* of the first end cap 22 of the straight tube lamp 20 can make contact. On the outer circumferential wall 51*d* of the body portion 51*c*, there is provided an insertion hole 51*e* for receiving the first lamp pins 24 protruding from the first end cap 22 of the straight tube lamp 20. The rotor 51*i* has a straight groove portion 51*kb* extending from the outer circumference of the rotor 51*i* along the radial direction of the rotor 51*i*. The first lamp pins 24 are inserted into the socket body 51 through the straight groove portion 51*kb*. The rotor 51*i* includes a cylindrical protrusion portion 51*k* that rotatably engages with a pair of semi-cylindrical salient portions 51*j* protruding from the central region of the inner bottom surface of the body portion 51*c*. The protrusion portion 51*k* protrudes toward the body portion 51*c* and has an inner diameter larger than the outer diameter of the salient portions 51*j*. The protrusion portion 51*k* of the rotor 51*i* has a claw portion 51*ka* engaging with insertion recess portions 51*ja* formed in the salient portions 51*j* (see FIG. 9). In other words, the rotor 51*i* can be rotated to align the straight groove portion 51*kb* with the insertion hole 51*e* on the outer circumferential wall 51*d*. The body portion 51*c* and the rotor 51*i* are formed by synthetic resin having an electric insulation property, thereby assuring electric insulation.

The conductor portions 51*h* are formed by bending a plate-like body made of a metallic material (e.g., copper alloy) having increased electric conductivity. The conductor portions 51*h* are arranged within the body portion 51*c* with the salient portions 51*j* interposed therebetween. The conductor portions 51*h* may be formed into an identical shape or different shapes. In this regard, the conductor portions 51*h* are fixed in place using inner wall portions 51*m* arranged inside the body portion 51*c*.

Each of the conductor portions 51*h* includes a contact piece 51*ha* formed in the central portion thereof to make contact with each of the first lamp pins 24 of the straight tube lamp 20. Each of the conductor portions 51*h* further includes a guide piece 51*hb* formed in one end portion of the contact piece 51*ha*. The guide piece 51*hb* is bent from the contact piece 51*ha* in such a direction that the spacing between the guide pieces 51*hb* becomes wider than the spacing between the contact pieces 51*ha*. Each of the conductor portions 51*h* further includes a base piece 51*hc* formed at the opposite side of the contact piece 51*ha* from the guide piece 51*hb*.

In the waterproof socket 10' holding the straight tube lamp 20, the contact piece 51*ha* of each of the conductor portions 51*h* arranged within the body portion 51*c* makes contact with each of the first lamp pins 24 of the straight tube lamp 20 in a state that the recess portions 22*b* of the straight tube lamp 20 are brought into contact with the socket surfaces 51*ia* of the rotor 51*i*. When the straight tube lamp 20 is mounted to the waterproof socket 10', the plate-like projection portion 24*a* of each of the first lamp pins 24 comes into elastic contact with the contact piece 51*ha* of each of the conductor portions 51*h*, whereby the first lamp pins 24 are held within the waterproof socket 10'. After each of the first lamp pins 24 is inserted into the insertion hole 51*e* along the straight groove portion 51*kb*, the straight tube lamp 20 is rotated about the center axis thereof, whereby the insertion hole 51*e* of the body portion 51*c* and the straight groove portion 51*kb* of the rotor 51*i* get out of alignment with each other. Thus the plate-like projection portion 24*a* of each of the first lamp pins 24 is held in place by the contact piece 51*ha* of each of the conductor portions 51*h* and is prevented from being removed from the waterproof socket 10'.

The socket body 51 has a plurality of (two, in the present embodiment) through-holes (not shown) extending from the base portion 51*a* to the body portion 51*c* through the support portion 51*b*. The through-holes of the base portion 51*a* serve as insertion holes for receiving electric wires (not shown) electrically connectable to the conductor portions 51*h*. Each of the conductor portions 51*h* may be configured to have a quick-connection terminal (not shown) so that the conductor portions 51*h* and the electric wires can be readily connected to each other. Attachment grooves 51*aa* to be engaged with a device for attachment of the waterproof socket 10' are appropriately formed on the opposite side surfaces of the base portion 51*a* of the socket body 51.

The socket body 51 includes a male thread 51*f* formed on the outer circumferential surface of the outer circumferential wall 51*d* of the body portion 51*c*. In this regard, the waterproof socket 10' includes a tightening cover 56 configured to cover the first end cap 22 of the straight tube lamp 20 mounted to the socket body 51 and tightened to the socket body 51 by the thread coupling with the male thread 51*f* of the body portion 51*c*.

As shown in FIG. 6A, the waterproof socket 10' employing the packing 54 of the present embodiment includes an annular socket packing 52, a cylindrical first internal sleeve 53 making contact with the socket body 51, a packing for restraining moisture from infiltrating through between the straight tube lamp 20 and the packing 54, and an annular second internal sleeve 55 for accommodating the packing 54 and pressing the packing 54 against the first internal sleeve 53 upon tightening the tightening cover 56. The socket packing 52, the first internal sleeve 53, the packing 54 and the second internal sleeve 55 are arranged between the socket body 51 and the tightening cover 56 in the named order from the socket body 51 toward the tightening cover 56.

The tightening cover 56 is formed into a cylindrical shape by synthetic resin. The tightening cover 56 has a cover opening 56*a* whose inner diameter is set a little larger than the outer diameter of the first end cap 22 so that the first end cap 22 of the straight tube lamp 20 can be inserted into the cover opening 56*a*. The tightening cover 56 has a female thread 56*c* formed on the inner circumferential surface thereof (see FIG. 9). The female thread 56*c* is threadedly coupled to the male thread 51*f* of the socket body 51. By rotating the tightening cover 56 about the center axis of the straight tube lamp 20 and threadedly coupling the female thread 56*c* with the male thread 51*f*, the tightening cover 56 can be removably attached to the socket body 51 so as to cover the outer circumferential surface of the first end cap 22 of the straight tube lamp 20 mounted to the socket body 51. The tightening cover 56 presses the packing 54 against the first internal sleeve 53 through the second internal sleeve 55. The tightening cover 56 accommodates the second internal sleeve 55, the packing 54 and the first internal sleeve 53 so that the tightening cover 56 can compress the packing 54 between the second internal sleeve 55 and the first internal sleeve 53 supporting the packing 54.

The second internal sleeve 55 includes a second internal sleeve body portion 55*b* extending toward the body portion 51*c* and a flange portion 55*d* protruding inward from one end of the second internal sleeve body portion 55*b*. The second internal sleeve 55 has a second internal sleeve opening 55*a* for receiving the first end cap 22 of the straight tube lamp 20. The second internal sleeve opening 55*a* has an inner diameter a little larger than the outer diameter of the first end cap 22 but smaller than the inner diameter of the cover opening 56*a*.

Figure 9:
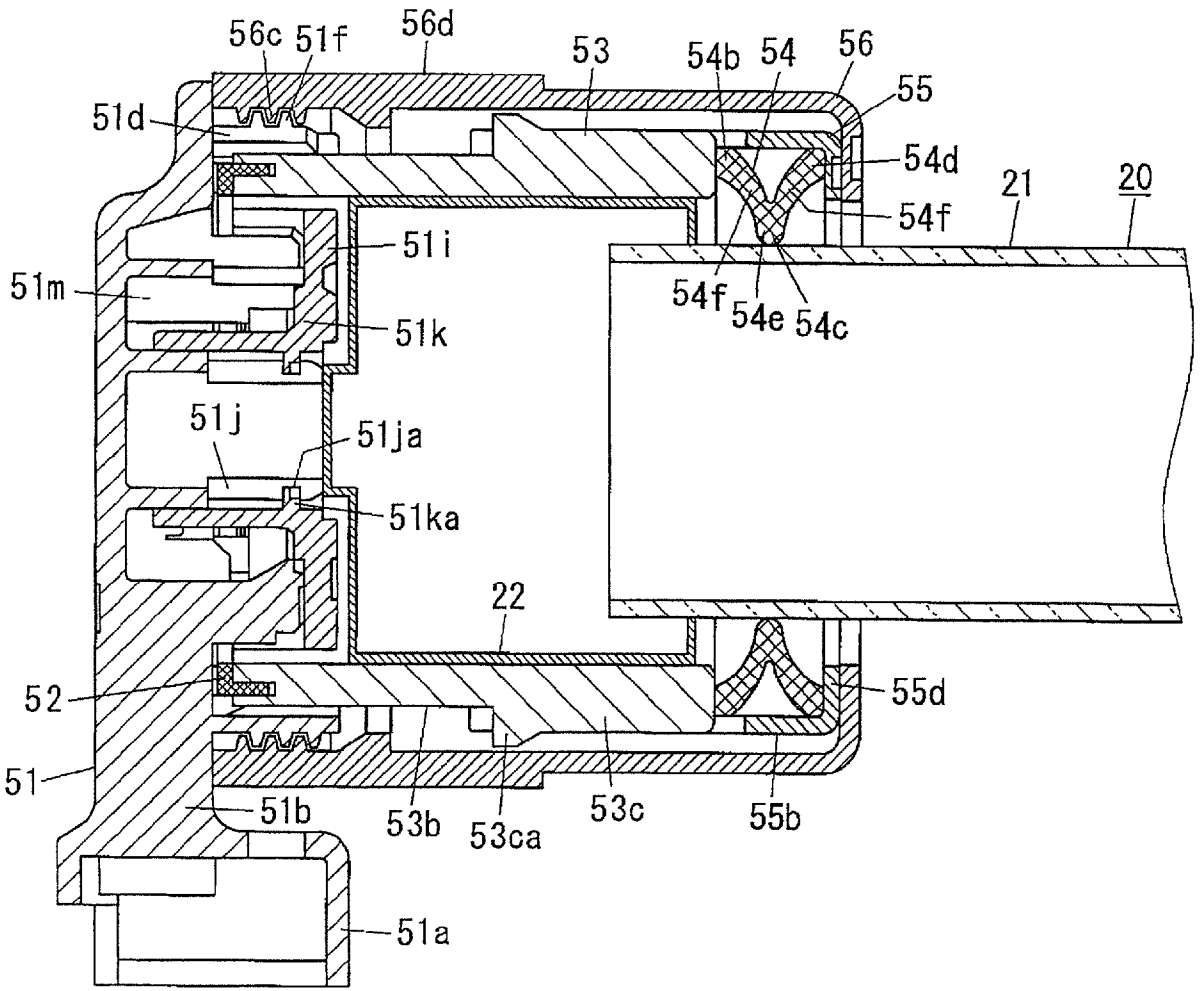
FIG. 9 is a section view of a waterproof socket provided with the waterproof socket packing of the fourth embodiment.

The packing 54 accommodated within the second internal sleeve 55 is arranged between the second internal sleeve 55 made of synthetic resin and the first internal sleeve 53 made of synthetic resin (see FIG. 9). The packing 54 is made of an elastic material. The packing 54 includes an annular first contact portion 54*b* making contact with the first internal sleeve 53 arranged at the side of the socket body 51 and an annular second contact portion 54*d* making contact with the flange portion 55*d* of the second internal sleeve 55 arranged at the side of the tightening cover 56. The packing 54 further includes a close-contact portion 54*c* arranged between the first contact portion 54*b* and the second contact portion 54*d*. The close-contact portion 54*c* is one-piece formed with the first contact portion 54*b* and the second contact portion 54*d* and is configured to make close contact with the light emitting tube 21 of the straight tube lamp 20.

The outer circumferences of the packing 54 extending from the close-contact portion 54*c* to the first contact portion 54*b* and extending from the close-contact portion 54*c* to the second contact portion 54*d* along the axial direction of the straight tube lamp 20 are formed into an outwardly-bulging curved surface shape. In the packing opening 54*a* through which the first end cap 22 of the straight tube lamp is inserted, the inner diameter of the first contact portion 54*b* and the inner diameter of the second contact portion 54*d* are set larger than the inner diameter of the close-contact portion 54*c*.

The outer diameter and radial thickness of the packing 54 is increased from the close-contact portion 54*c* toward the first contact portion 54*b* and from the close-contact portion 54*c* toward the second contact portion 54*d* along the axial direction of the straight tube lamp 20. Moreover, the inner diameter and radial thickness of the packing 54 is increased from the close-contact portion 54*c* toward the first contact portion 54*b* and from the close-contact portion 54*c* toward the second contact portion 54*d* along the axial direction of the straight tube lamp 20.

Accordingly, when the first contact portion 54*b* and the second contact portion 54*d* are pressed toward each other (see FIG. 8), the packing 54 can make close contact with the straight tube lamp 20 while restraining an unintentional portion of the packing 54 from being buckled. In addition, when the first contact portion 54*b* and the second contact portion 54*d* are pressed toward each other (see FIG. 8), the displacement of the packing 54 can be increased so as to reduce the inner diameter of the packing opening 54*a*.

The packing 54 of the present embodiment includes a jutting portion 54*e* formed in the close-contact portion 54*c* to protrude inwardly. When inserting the straight tube lamp into the packing 54, the jutting portion 54*e* can be brought into contact with the straight tube lamp 20 and can be deformed in the insertion direction of the straight tube lamp 20. When the first contact portion 54*b* and the second contact portion 54*d* are pressed toward each other (see FIG. 8), the jutting portion 54*e* makes contact with the straight tube lamp 20 inserted through the packing 54. If the packing 54 makes contact with the straight tube lamp 20 and interferes with the first end cap 22 when inserting the straight tube lamp 20 into the packing 54, the jutting portion 54*e* is deformed in the insertion direction of the straight tube lamp 20. Accordingly, the straight tube lamp 20 can be inserted through the packing 54 without applying an excessive load to the packing 54 or the straight tube lamp 20.

In the packing 54, the inner diameter of the packing opening 54*a* can be set a little smaller than the outer diameter of the first end cap 22. In the packing 54, when the first contact portion 54*b* and the second contact portion 54*d* are pressed toward each other (see FIG. 8), it is possible to reduce the deformation of the packing 54 caused by the application of pressure and to restrain buckling of the packing 54.

The packing 54 of the present embodiment includes a thin portion 54*f* with a smallest radial thickness arranged between the close-contact portion 54*c* and the first contact portion 54*b* making contact with the first internal sleeve 53. Similarly, the packing 54 of the present embodiment includes a thin portion 54*f* with a smallest radial thickness arranged between the close-contact portion 54*c* and the second contact portion 54*d* making contact with the second internal sleeve 55. Accordingly, when the first contact portion 54*b* and the second contact portion 54*d* are pressed toward each other (see FIG. 8), the jutting portion 54*e* of the packing 54 can make close contact with the straight tube lamp 20 while restraining an unintentional portion of the packing 54 from being buckled. In addition, when the first contact portion 54*b* and the second contact portion 54*d* are pressed toward each other (see FIG. 8), the displacement of the packing 54 can be increased so as to reduce the inner diameter of the packing opening 54*a*.

In the packing 54, the first contact portion 54*b* and the second contact portion 54*d* are symmetrical with respect to the close-contact portion 54*c*. It is therefore possible to, when assembling the waterproof socket 10', swap the positions of the first contact portion 54*b* and the second contact portion 54*d* shown in FIG. 6. This makes it possible to enhance the workability when assembling the waterproof socket 10'.

Figure 10:
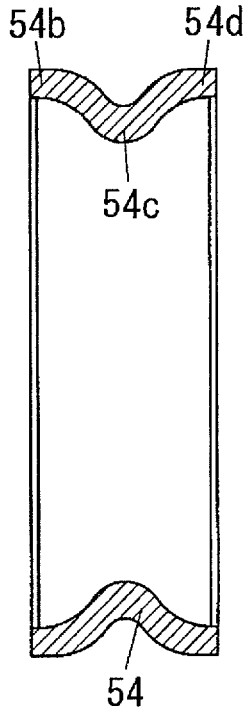
FIG. 10 is a vertical section view showing a modified example of the waterproof socket packing.

Unlike the packing 54 of the first embodiment shown in FIG. 9, the portion between the close-contact portion 54*c* and the first contact portion 54*b* and the portion between the close-contact portion 54*c* and the second contact portion 54*d* may have an increased thickness substantially uniform in the radial thickness as shown in FIG. 10.

By increasing the thickness in this manner, wrinkles are hardly generated in the packing 54 and the waterproof socket 10' has an increased waterproof property as compared with the packing 54 shown in FIG. 9.

If the tightening cover 56 is threadedly coupled to the body portion 51*c*, the first internal sleeve 53 makes contact with the first contact portion 54*b* of the packing 54. Thus the packing 54 can be supported on the body portion 51*c*. The first internal sleeve 53 includes a cylindrical first internal sleeve body portion 53*b* whose inner diameter is set a little larger than the outer diameter of the first end cap 22 so that the first end cap 22 of the straight tube lamp 20 can be inserted into the first internal sleeve opening 53*a*.

In the waterproof socket 10', as shown in FIG. 9, the packing 54 making contact with the straight tube lamp 20 is arranged between the first internal sleeve 53 and the second internal sleeve 55 in the space surrounded by the tightening cover 56 and the body portion 51*c* threadedly coupled to the tightening cover 56.

As the tightening cover 56 is threadedly coupled to the body portion 51*c*, the flange portion 55*d* of the second internal sleeve 55 presses the second contact portion 54*d* of the packing 54. As a result, the inner diameter of the packing opening 54*a* of the packing 54 is decreased from, e.g., 29 mm to 23.5 mm. Thus the close-contact portion 54*c* makes close contact with the light emitting tube 21 of the straight tube lamp 20. The second internal sleeve 55 is made of a synthetic resin material smaller in tackiness and frictional coefficient than the packing 54. Similarly, the first internal sleeve 53 is made of a synthetic resin material smaller in tackiness and frictional coefficient than the packing 54. In order to facilitate thread coupling with the body portion 51*c*, the tightening cover 56 includes a slip-preventing portion 56*d* formed on the outer circumferential surface thereof. The slip-preventing portion 56*d* serves to prevent the fingers of a user from slipping in a circumferential direction about the center axis. The slip-preventing portion 56*d* may be, e.g., a plurality of axially-extending protrusions formed on the outer circumferential surface of the tightening cover 56.

In the waterproof socket 10', as compared with the waterproof socket structure in which the tightening cover 56 makes direct contact with the packing 54, it is possible to, when rotating the tightening cover 56 about the center axis and tightening the same to the body portion 51*c*, easily rotate the tightening cover 56 with respect to the body portion 51*c* while maintaining close contact between the straight tube lamp 20 and the packing 54.

In order to prevent the co-rotation by which the straight tube lamp 20 is rotated together with the tightening cover 56, the first internal sleeve 53 includes serrated sleeve-side rotation restraint portions 53*d* protruding from one end of the first internal sleeve body portion 53*b* toward the body portion 51*c*. In other words, the first internal sleeve 53 includes sleeve-side rotation restraint portions 53*d* for restraining the first internal sleeve 53 from rotating about the center axis of the straight tube lamp 20. The socket body 51 includes serrated body-side rotation restraint portions 51*g* protruding from the inner surface of the outer circumferential wall 51*d* of the body portion 51*c* and engaging with the sleeve-side rotation restraint portions 53*b* of the first internal sleeve 53. The body-side rotation restraint portions 51*g* allows the first internal sleeve 53 to rotate in one direction about the center axis of the straight tube lamp 20 while restraining the first internal sleeve 53 from rotating in the other direction opposite to said one direction. In the waterproof socket 10', when mounting the straight tube lamp 20, the serrated sleeve-side rotation restraint portions 53*d* of the first internal sleeve 53 engage with the serrated body-side rotation restraint portions 51*g* of the body portion 51*c*. Since the sleeve-side rotation restraint portions 53*d* and the body-side rotation restraint portions 51*g* have a mutually-engaging serrated shape, it is possible to restrain the first internal sleeve from rotating in the tightening direction of the tightening cover 56. It is also possible to enable the sleeve-side rotation restraint portions 53*d* and the body-side rotation restraint portions 51*g* to be readily disengaged from each other when removing the tightening cover 56 from the socket body 51.

The sleeve-side rotation restraint portions 53*d* and the body-side rotation restraint portions 51*g* may have any shape insofar as they can engage with each other to restrain rotation of the first internal sleeve 53. The shape of the body-side rotation restraint portions 51*g* is not limited to the serrated shape but may be, e.g., a raised shape. In this case, the shape of the sleeve-side rotation restraint portions 53*d* may be a recessed shape complementary to the raised shape of the body-side rotation restraint portions 51*g*.

In order to restrain the straight tube lamp 20 from rotating together with the tightening cover 56, the first internal sleeve 53 includes a plurality of first position restraint portions 53*c*. The first position restraint portions 53*c* are raised portions and are formed into an outwardly-protruding rectangular solid shape extending along the axial direction of the straight tube lamp 20. In the waterproof socket 10', lug portions 53*ca* are formed on the outer circumferential surface of the first internal sleeve 53.

The tightening cover 56 of the waterproof socket 10' has a female thread 56*c* formed on the inner circumferential surface thereof and threadedly coupled to the socket body 51. Insertion passage portions (not shown) extending in the axial direction of the straight tube lamp 20 are formed in the female thread 56*c*. The first internal sleeve 53 includes lug portions 53*ca* outwardly protruding from the first position restraint portions 53*c* formed on the outer circumferential surface of the first internal sleeve 53.

The lug portions 53*ca* can pass through the insertion passage portions in the axial direction of the straight tube lamp 20. In the waterproof socket 10', the lug portions 53*ca* can be locked to the female thread 56*c* in the positions where the lug portions 53*ca* get out of alignment with the insertion passage portions in a circumferential direction about the center axis of the straight tube lamp 20.

In the waterproof socket 10', if the lug portions 53*ca* are inserted through the insertion passage portions and are caused to get out of alignment with the insertion passage portions in a circumferential direction about the center axis of the straight tube lamp 20, it is possible to prevent the first internal sleeve 53 from being easily removed from the tightening cover 56. This makes it possible to arrange the first internal sleeve 53 within the tightening cover 56 while maintaining the packing 54 and the second internal sleeve 55 between the tightening cover 56 and the first internal sleeve 53. With the waterproof socket 10' employing the packing 54 of the present embodiment, it is easy to tighten the tightening cover 56 to the socket body 51. It is also easy to mount the straight tube lamp 20 in a waterproof manner.

In the waterproof socket 10', the groove-like insertion passage portions through which the lug portions 53*ca* are inserted in the axial direction of the straight tube lamp 20 may have a constant width or a width growing smaller away from the socket body 51. The insertion passage portions with a width growing smaller away from the socket body 51 makes it easy to insert the lug portions 53*ca* into the insertion passage portions and helps prevent the first internal sleeve 53 from being easily removed from the tightening cover 56.

In the waterproof socket 10', the circumferential interval between the insertion passage portions and the circumferential interval between the lug portions 53*ca* may be set equal about the center axis of straight tube lamp 20. Alternatively, the circumferential interval between the insertion passage portions and the circumferential interval between the lug portions 3*ca* may be set different about the center axis of straight tube lamp 20. With the waterproof socket 10' in which the insertion passage portions are arranged in different intervals, it is possible to prevent the first internal sleeve 53 from being easily removed from the tightening cover 56.

The second internal sleeve 55 is movable with respect to the first internal sleeve 53 in the axial direction of the straight tube lamp 20. The second internal sleeve 55 engages with the first position restraint portions 53*c* of the first internal sleeve 53 so that the second internal sleeve 55 can be restrained from rotating about the center axis of the straight tube lamp 20. For this purpose, the second internal sleeve 55 includes a plurality of second position restraint portions 55*c* as cutout portions extending along the axial direction of the straight tube lamp 20 from the end of the second internal sleeve body portion 55*b* facing the body portion 51*c*. The second position restraint portions 55*c* are formed along the outer circumference of the second internal sleeve 55.

In the waterproof socket 10', when the tightening cover 56 is tightened to the body portion 51*c* by rotating about the center axis, it is possible to threadedly couple the tightening cover 56 to the body portion 51*c* while restraining the co-rotation of the straight tube lamp 20.

The first position restraint portions 53*c* are not limited to the raised portions set forth above and the second position restraint portions 55*c* are not limited to the cutout portions set forth above. Alternatively, one of the first position restraint portions 53*c* and the second position restraint portions 55*c* may be raised portions and the other may be cutout portions or groove portions engaging with the raised portions.

The socket packing 52, the first internal sleeve 53 and the second internal sleeve 55 are not necessarily provided in the waterproof socket 10' as long as the packing of the present embodiment is capable of making close contact with the straight tube lamp 20 in a waterproof manner. In this case, the waterproof socket 10' may be configured to include, e.g., an annular protrusion portion protruding from the body portion 51*c* to support the packing 54.

While not shown in the drawings, the waterproof socket for holding the second end cap 23 of the straight tube lamp 20 has substantially the same external shape as the waterproof socket 10' for holding the first end cap 22 of the straight tube lamp 20. The waterproof socket for holding the second end cap 23 has a socket surface with which the second end cap 23 of the straight tube lamp 20 can make contact. The waterproof socket for holding the second end cap 23 can be configured to have a groove formed on the socket surface. The second lamp pin 25 of the straight tube lamp 20 is inserted into the groove. The groove is capable of holding the shaft portion 25*a* of the second lamp pin 25 so that the shaft portion 25*a* can rotate about the center axis of the straight tube lamp 20. Alternatively, the waterproof socket may be configured to have a straight groove extending from the outer circumferential wall of a socket body toward the center of the socket body. The straight groove is capable of holding the shaft portion 25*a* of the second lamp pin 25 so that the shaft portion 25*a* can rotate about the center axis of the straight tube lamp 20. In this regard, the portion of the straight groove existing on the outer circumferential wall of the socket body becomes an insertion hole for receiving the second lamp pin 25 protruding from the second end cap 23 of the straight tube lamp 20. The waterproof socket for holding the second end cap 23 includes a second conductor plate as a grounding conductor plate arranged inside the waterproof socket. The second conductor plate makes up a conductor portion electrically connectable to the second lamp pin 25 protruding from the second end cap 23. The second conductor plate is electrically connected to the second lamp pin 25 as a grounding earth pin. The second conductor plate can serve as a grounding earth terminal. The second conductor plate is electrically connected to an object outside the waterproof socket for grounding purposes. Alternatively, the second conductor plate may be used to merely hold the second lamp pin 25. Just like the waterproof socket 10' for holding the first end cap 22, the waterproof socket for holding the second end cap 23 covers the second end cap 23 of the straight tube lamp 20 and includes a first internal sleeve, a packing and a second internal sleeve. When the tightening cover is threadedly coupled to the socket body about the center axis of the straight tube lamp 20, the first internal sleeve, the packing and the second internal sleeve are arranged between the socket body and the tightening cover in the named order from the socket body toward the tightening cover. The socket body of the waterproof socket for holding the second end cap 23 includes a body-side rotation restraint portion engaging with a sleeve-side rotation restraint portion. The second internal sleeve includes a second position restraint portion engaging with a first position restraint portion of the first internal sleeve. The first position restraint portion and the second position restraint portion restrain the second internal sleeve from rotating with respect to the first internal sleeve in the rotating direction of the straight tube lamp 20 while allowing the second internal sleeve to move along the axial direction of the straight tube lamp 20.

In this regard, the packing includes a first contact portion making contact with the socket body and a second contact portion making contact with the tightening cover. The packing further includes a close-contact portion arranged between the first contact portion and the second contact portion. The close-contact portion is one-piece formed with the first contact portion and the second contact portion and is configured to make close contact with the light emitting tube 21 of the straight tube lamp 20. The outer circumferences of the packing extending from the close-contact portion to the first contact portion and extending from the close-contact portion to the second contact portion along the axial direction of the straight tube lamp 20 are formed into an outwardly-bulging curved surface shape. In the packing opening through which the second end cap 23 of the straight tube lamp 20 is inserted, the inner diameter of the first contact portion and the inner diameter of the second contact portion are set larger than the inner diameter of the close-contact portion.

In other words, the waterproof socket for holding the second end cap 23 of the straight tube lamp 20 is structurally the same as the waterproof socket 10' for holding the first end cap 22 of the straight tube lamp 20, except the structure for holding the second end cap 23 of the straight tube lamp 20.

Next, description will be made on a method of mounting the straight tube lamp 20 to the waterproof socket 10' employing the packing 54 of the present embodiment to obtain a waterproof structure.

When mounting the straight tube lamp 20 to the waterproof socket 10', the straight tube lamp 20 is first inserted into the packing opening 52*a* of the socket packing 52, the first internal sleeve opening 53*a* of the first internal sleeve 53, the packing opening 54*a* of the packing 54, the second internal sleeve opening 55*a* of the second internal sleeve 55 and the cover opening 56*a* of the tightening cover 56. Then, the first end cap 22 of the straight tube lamp 20 is positioned at the side of the socket surface 51*ia* of the waterproof socket 10' and the second end cap 23 of the straight tube lamp 20 is positioned at the side of the socket surface of the waterproof socket for holding the second end cap 23. In this state, the straight tube lamp 20 is moved toward the waterproof socket 10'. Then, the first lamp pins 24 of the first end cap 22 are inserted into the insertion hole 51*e* of the waterproof socket 10'. Similarly, the second lamp pin 25 of the second end cap 23 is inserted into the second insertion hole of the second socket surface of the waterproof socket for the second end cap 23. Thereafter, the straight tube lamp 20 is rotated about the center axis thereof with respect to the waterproof socket 10', whereby the straight tube lamp 20 is mounted to the waterproof socket 10'.

As a consequence, each of the first lamp pins 24 is inserted into the socket body 51 through the insertion hole 51*e* and is fitted to the contact piece 51*ha* of the conductor portion 51*h* while rotating the rotor 51*i*.

As the plate-like projection portion 24*a* of each of the first lamp pins 24 is inserted into the insertion hole 51*e*, the contact piece 51*ha* of the conductor portion 51*h* is bent outward. Thereafter, the plate-like projection portion 24*a* is kept in contact with the contact piece 51*ha* by the elastic force of the contact piece 51*ha*.

In the waterproof socket 10', the contact pieces 51*ha* of the conductor portions 51*h* are electrically connected to the first lamp pins 24 of the straight tube lamp 20. At the same time, the contact pieces 51*ha* mechanically hold the straight tube lamp 20.

In this state, the positional relationship between the mounting substrate and the first lamp pins 24 or the second lamp pin 25 is set so that the light emitting diodes existing within the light emitting tube 21 can face a specified irradiation surface. At this time, the first lamp pins 24 are electrically connected to the conductor portions 51*h* arranged within the body portion 51*c* of the waterproof socket 10'. Consequently, the waterproof socket 10', can supply a DC current to the light emitting diodes of the straight tube lamp 20 through the conductor portions 51*h*. The increased diameter portion 25*b* of the second lamp pin 25 of the straight tube lamp 20 is electrically connected to the second conductor plate. Thus the second lamp pin 25 serves as a grounding earth pin. In other words, the waterproof socket for the second end cap 23 can hold the second end cap 23 of the straight tube lamp 20 and can perform the earth connection of the straight tube lamp 20. Next, the socket packing 52, the first internal sleeve 53, the packing 54, the second internal sleeve 55 and the tightening cover 56, through which the straight tube lamp 20 is inserted, are moved toward the socket body 51. The outer circumference of the socket packing 52 is brought into contact with the first internal sleeve opening 53*a* of the first internal sleeve 53. The sleeve-side rotation restraint portions 53*d* of the first internal sleeve 53 are caused to engage with the body-side rotation restraint portions 51*g* of the socket body 51. The first contact portion 54*b* of the packing 54 is brought into contact with the end of the first internal sleeve body portion 53*b* of the first internal sleeve 53. The second internal sleeve 55 covers and accommodates the packing 54. The tightening cover 56 covers the second internal sleeve 55. The position restraint portions 55*c* of the second internal sleeve 55 as cutout portions are fitted to the position restraint portions 53*c* of the first internal sleeve 53 as raised portions. In this state, the tightening cover 56 covering the socket packing 52, the first internal sleeve 53, the packing 54 and the second internal sleeve 55, through which the straight tube lamp 20 is inserted, is threadedly coupled to the socket body 51 of the waterproof socket 10'. At this time, the straight tube lamp 20 is mounted so that the light emitting diodes can face a specified irradiation surface.

In the waterproof socket 10', the rotation restraint portions 51*g* of the socket body 51 engage with the rotation restraint portions 53*d* of the first internal sleeve 53. It is therefore possible to restrain the first internal sleeve 53 from rotating with respect to the socket body 51 about the center axis of the straight tube lamp 20. Since the first position restraint portions 53*c* and the second position restraint portions 55*c* engage with each other, it is possible to, when tightening the tightening cover 56, prevent the first internal sleeve 53 and the second internal sleeve 55 from rotating with respect to the socket body 51 about the center axis of the straight tube lamp 20.

In the waterproof socket 10' employing the packing 54 of the present embodiment, it is therefore possible to restrain the straight tube lamp 20 from rotating together with the tightening cover 56. This makes it possible to mount the straight tube lamp 20 in a state that the insertion direction of the straight tube lamp 20 with respect to the waterproof socket 10' is fixed to a specified direction. In other words, the waterproof socket 10' of the present embodiment is capable of restraining unintentional rotation of the straight tube lamp 20.

In the waterproof socket 10', the first contact portion 54*b* and the second contact portion 54*d* of the packing 54 are pressed toward each other as the tightening cover 56 is threadedly coupled to the socket body 51. In the waterproof socket 10' employing the packing 54 of the present embodiment, the packing 54 is prevented from being unintentionally buckled in the axial direction of the straight tube lamp 20. This makes it possible to restrain reduction of a waterproof property.

With the waterproof socket 10' having an enhanced waterproof property, it is possible to restrain moisture from infiltrating into the waterproof socket 10'. It is also possible to enhance the dustproof property, thereby restraining debris or dust from infiltrating into the waterproof socket 10'.

While the one-side power-feeding type straight tube lamp provided with an L-type end cap is employed as the straight tube lamp 20 in the waterproof socket 10' employing the packing 54 of the present embodiment, the waterproof socket 10' may be used to hold a double-side power-feeding type straight tube lamp. In other words, the waterproof socket 10' may be used to hold not only a one-side power-feeding type straight tube lamp but also a double-side power-feeding type straight tube lamp. In the latter case, electric power can be feed through the waterproof socket 10' making contact with the first end cap 22 attached to one end of the straight tube lamp 20 and the waterproof socket 10' making contact with the second end cap 23 attached to the other end of the straight tube lamp 20.

(Fifth Embodiment)

Figure 11:
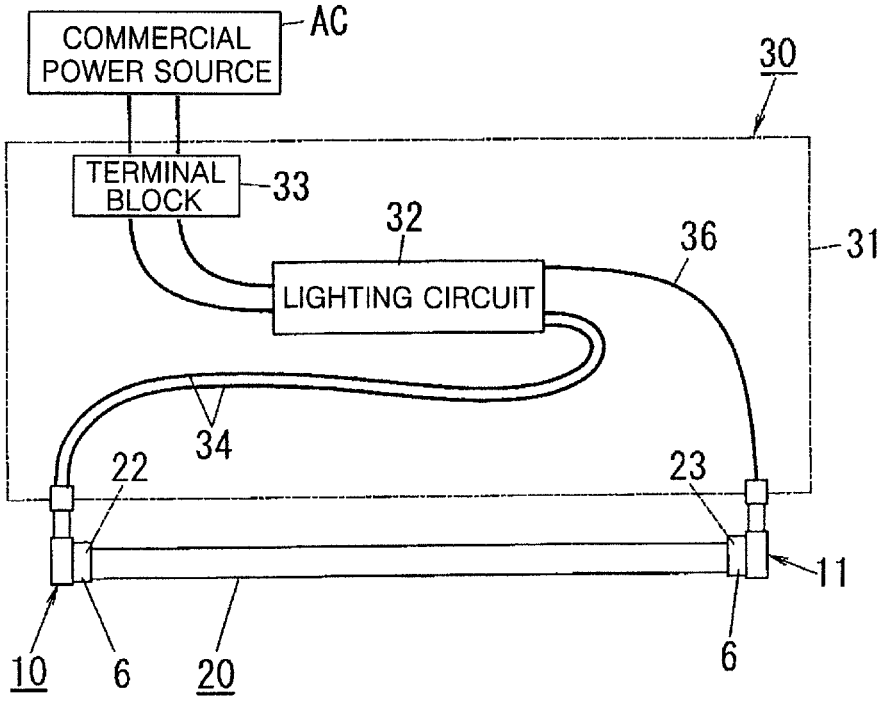
FIG. 11 is a schematic configuration view showing an illumination apparatus according to a fifth embodiment.
Figure 12:
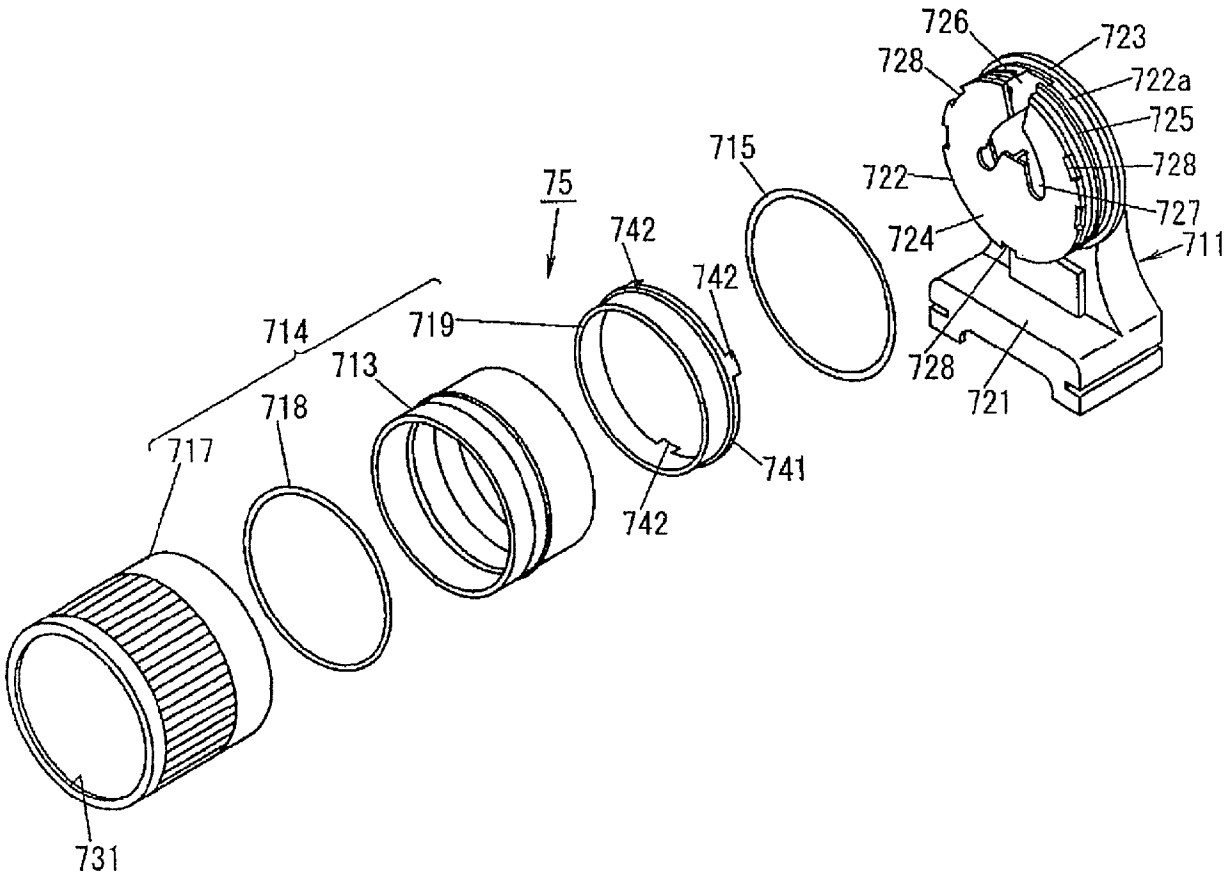
FIG. 12 is an exploded perspective view showing a conventional waterproof socket.
Figure 13:
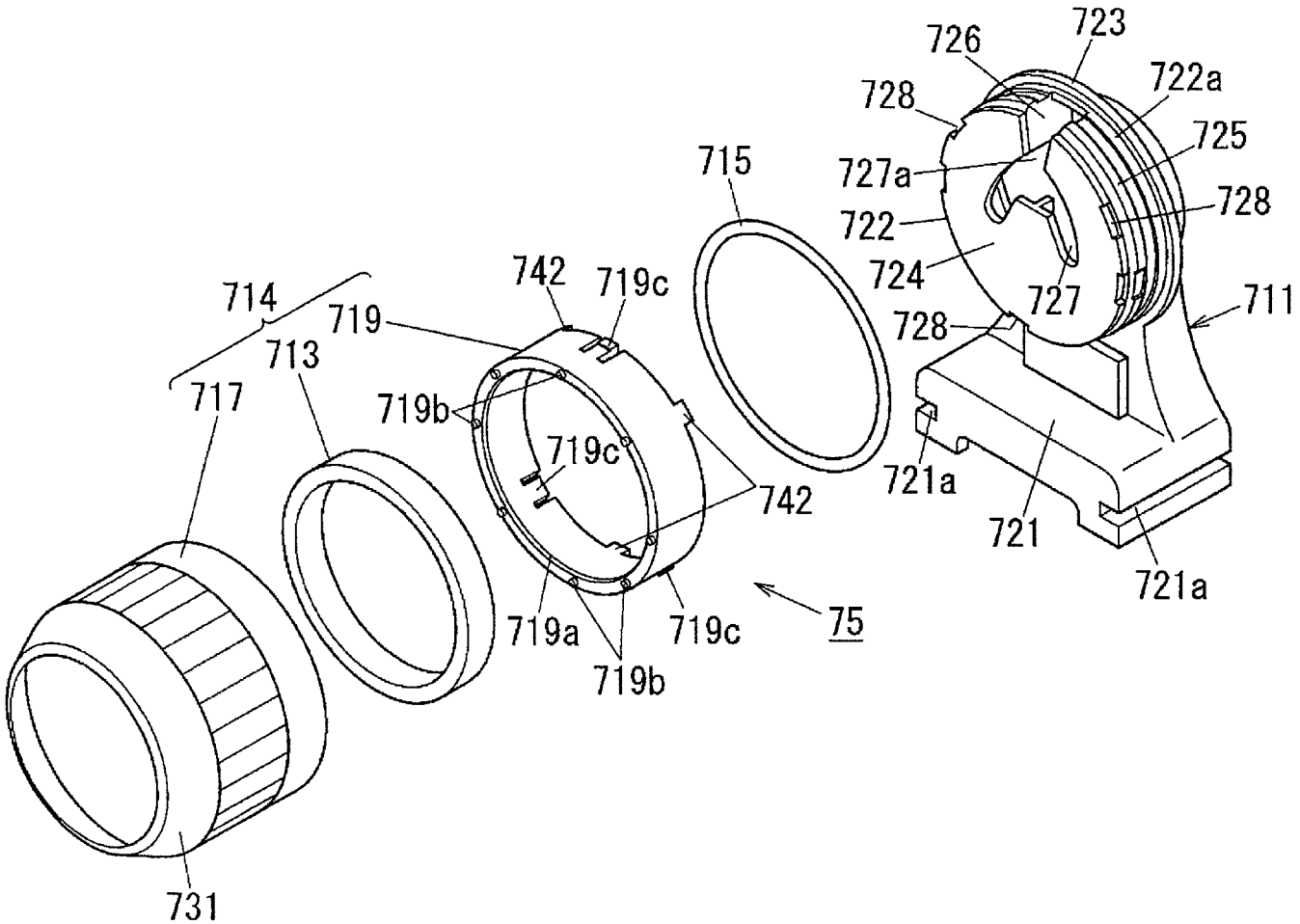
FIG. 13 is an exploded perspective view showing another conventional waterproof socket.
Figure 14:
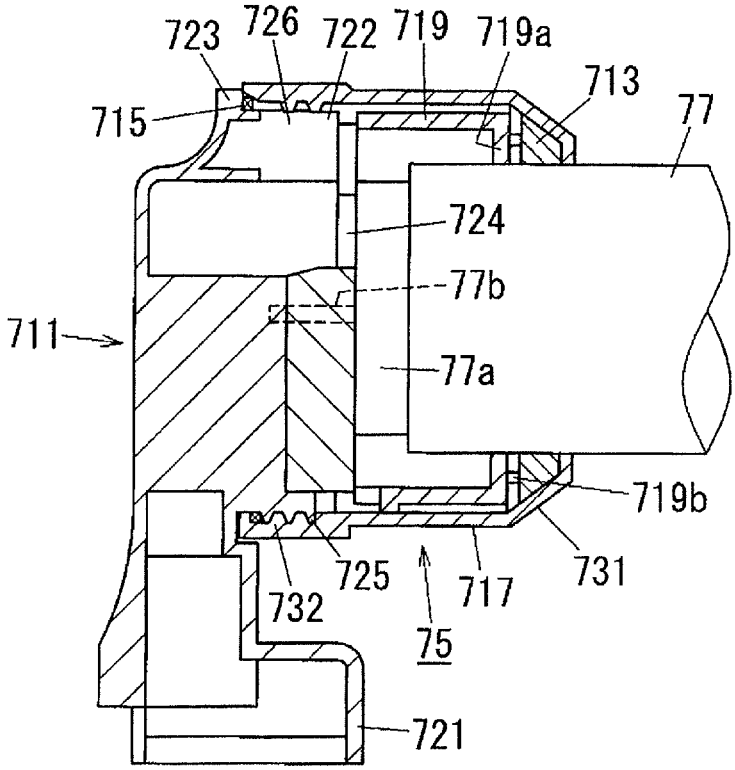
FIG. 14 is a section view of the waterproof socket shown in FIG. 13, which is in an assembled state.

Next, an illumination apparatus 30 provided with a waterproof socket 10 described in respect of the first embodiment will be described with reference to FIG. 11.

The illumination apparatus 30 of the present embodiment includes a lighting instrument 31 capable of holding the straight tube lamp 20. The lighting instrument 31 includes the waterproof socket 10 of the first embodiment shown in FIG. 1. The waterproof socket 10 makes contact with the first end cap 22 of the straight tube lamp 20 to supply electric power to the straight tube lamp 20. The lighting instrument 31 further includes a waterproof socket 11 for holding the second end cap 23 described in respect of the first embodiment. The waterproof socket 11 can make contact with the second end cap 23 of the straight tube lamp 20 and can be electrically connected to the second lamp pin 25 as a grounding terminal. Within the lighting instrument 31, there are arranged a terminal block 33 and a lighting circuit 32. Power supply lines leading from a commercial power source AC are connected to the terminal block 33. The lighting circuit 32 converts the alternating current voltage supplied from the commercial power source AC through the terminal block 33 to a specified direct current voltage suitable for use in the straight tube lamp 20. The lighting circuit 32 drops the direct current voltage and supplies the direct current voltage to the straight tube lamp 20. The output terminal of the lighting circuit 32 is connected to the waterproof socket 10 through a wiring line 34. Electric power is fed from the first end cap 22 of the straight tube lamp 20 mounted to the waterproof socket 10. The earth terminal portion of the lighting circuit 32 is electrically connected to the waterproof socket 11 provided at the other end (at the right end in FIG. 11) through a wiring line 36.

In the illumination apparatus 30, the waterproof sockets 10 and 11 are provided to protrude from the body of the lighting instrument 31 so that the straight tube lamp 20 can be held in the longitudinal end portions of the lighting instrument 31. In other words, the illumination apparatus 30 holds the straight tube lamp 20 by mounting the first and second end caps 22 and 23 provided at the opposite ends of the light emitting tube 21 of the straight tube lamp 20 to the waterproof sockets 10 and 11. In the illumination apparatus 30, the waterproof sockets 10 and 11 are arranged at a specified interval in conformity with the distance between the first and second end caps 22 and 23 of the straight tube lamp 20.

The illumination apparatus 30 may be configured to include not only the waterproof socket 10 of the first embodiment but also the waterproof sockets 10 and 10' of the second, third and fourth embodiments.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A waterproof socket, comprising:

a socket body having an insertion hole to which a lamp pin protruding from an end cap of a straight tube lamp is inserted, the straight tube lamp being mounted to the waterproof socket by rotating the straight tube lamp about a center axis thereof;

a tightening cover for covering the end cap of the straight tube lamp mounted to the socket body, the tightening cover being tightened to the socket body by thread coupling about the center axis;

a first internal sleeve making contact with the socket body;

a tubular seal for restraining moisture from infiltrating through between the straight tube lamp and the tubular seal; and a second internal sleeve for accommodating the seal and pressing the seal against the first internal sleeve upon tightening the tightening cover, wherein the first internal sleeve, the seal and the second internal sleeve being arranged between the socket body and the tightening cover in the named order from the socket body toward the tightening cover and the straight tube lamp is inserted through the second internal sleeve, the seal, and the first internal sleeve, wherein the socket body includes a body-side rotation restraint portion engaging with a sleeve-side rotation restraint portion formed in the first internal sleeve to restrain the first internal sleeve from rotating about the center axis, and wherein the first internal sleeve includes a first position restraint portion and the second internal sleeve includes a second position restraint portion engaging with the first position restraint portion of the first internal sleeve to restrain the second internal sleeve from rotating about the center axis while allowing the second internal sleeve to move in an axial direction of the straight tube lamp.

2. The socket of claim 1, wherein one of the first position restraint portion and the second position restraint portion is a raised portion and the other is a cutout portion or a groove portion engaging with the raised portion.

3. The socket of claim 1, wherein one of the sleeve-side rotation restraint portion and the body-side rotation restraint portion is a protruding portion and the other is a recessed portion engaging with the protruding portion.

4. The socket of claim 1, wherein the sleeve-side rotation restraint portion has a serrated shape, and the body-side rotation restraint portion has a serrated shape so that the body-side rotation restraint portion engages with the sleeve-side rotation restraint portion to allow the first internal sleeve to rotate about the center axis in one direction while restraining the first internal sleeve from rotating in the other direction opposite to said one direction.

5. An illumination apparatus comprising the waterproof socket of claim 1.

6. The socket of claim 1, wherein the tightening cover includes a female thread formed on an inner circumferential surface thereof and threadedly coupled to the socket body, the female thread having insertion passage portions extending in the axial direction; the first internal sleeve has lug portions formed on an outer circumferential surface thereof, the lug portions being inserted through the insertion passage portions; and the lug portions lock to the female thread in a position where the lug portions get out of alignment with the insertion passage portions in a circumferential direction about the center axis of the straight tube lamp.

7. The socket of claim 6, wherein the insertion passage portions have a width growing smaller away from the socket body.

8. The socket of claim 6, wherein the circumferential interval between the insertion passage portions differs from the circumferential interval between the lug portions about the center axis.

9. A packing for use in a waterproof socket including a socket body having an insertion hole to which a lamp pin protruding from an end cap of a straight tube lamp is inserted, and a tightening cover for covering the end cap of the straight tube lamp mounted to the socket body, the tightening cover being tightened to the socket body by thread coupling about the center axis, the packing being arranged between the socket body and the tightening cover to prevent moisture from infiltrating through between the packing and the straight tube lamp, the straight tube lamp being inserted through the packing, the packing comprising:

a first contact portion making contact with the socket body;

a second contact portion making contact with the tightening cover; and a close-contact portion arranged between the first contact portion and the second contact portion, the close-contact portion being one-piece formed with the first contact portion and the second contact portion, the close-contact portion being configured to make close contact with a light emitting tube of the straight tube lamp, wherein outer circumferential surfaces of the packing extending from the close-contact portion to the first contact portion and extending from the close-contact portion to the second contact portion along an axial direction of the straight tube lamp are formed into an outwardly-bulging curved surface shape, and wherein an inner diameter of the first contact portion and an inner diameter of the second contact portion are larger than an inner diameter of the close-contact portion in a packing opening through which the straight tube lamp is inserted.

10. The packing of claim 9, wherein an outer diameter and a radial thickness of the packing are increased from the close-contact portion toward the first contact portion and from the close-contact portion toward the second contact portion along the axial direction of the straight tube lamp.

11. The packing of claim 9, wherein an inner diameter and a radial thickness of the packing are increased from the close-contact portion toward the first contact portion and from the close-contact portion toward the second contact portion along the axial direction of the straight tube lamp.

12. The packing of claim 9, further comprising: a thin portion with a smallest radial thickness arranged at least between the close-contact portion and the first contact portion or between the close-contact portion and the second contact portion.

13. The packing of claim 9, wherein the first contact portion and the second contact portion are symmetrical with respect to the close-contact portion.

14. The packing of claim 9, further comprising: a jutting portion formed in the close-contact portion to protrude inwardly, the jutting portion being brought into contact with the straight tube lamp and deformed in an insertion direction of the straight tube lamp when the straight tube lamp is inserted through the packing.

15. A waterproof socket comprising the packing of claim 9.

16. An illumination apparatus comprising the waterproof socket of claim 15.

* * * * *